US012168554B2

(12) United States Patent
Hirdler et al.

(10) Patent No.: US 12,168,554 B2
(45) Date of Patent: Dec. 17, 2024

(54) MECHANICAL PRESSURE RELIEF VALVE FOR USE IN LIVE BEVERAGES

(71) Applicant: Craft Innovators, LLC, Rochester, MN (US)

(72) Inventors: Jacob B. Hirdler, Rochester, MN (US); Jacob J. Teske, Rochester, MN (US); Mitch Podhora, New Richmond, WI (US); Tyler Mustard, Eau Claire, WI (US)

(73) Assignee: Craft Innovators, LLC, Rochester, MN (US)

( * ) Notice: Subject to any disclaimer, the term of this patent is extended or adjusted under 35 U.S.C. 154(b) by 0 days.

(21) Appl. No.: 18/333,065

(22) Filed: Jun. 12, 2023

(65) Prior Publication Data

US 2023/0331448 A1 Oct. 19, 2023

Related U.S. Application Data

(63) Continuation of application No. 17/213,870, filed on Mar. 26, 2021, now Pat. No. 11,780,658.

(60) Provisional application No. 63/000,958, filed on Mar. 27, 2020.

(51) Int. Cl.

| | |
|---|---|
| ***B65D 51/16*** | (2006.01) |
| ***B65D 85/72*** | (2006.01) |
| *B65D 17/28* | (2006.01) |

(52) U.S. Cl.

CPC ..... *B65D 51/1644* (2013.01); *B65D 85/72* (2013.01); *B65D 17/401* (2018.01); *B65D 2205/02* (2013.01); *B65D 2401/00* (2020.05)

(58) Field of Classification Search

CPC ..... B67D 1/12; B67D 1/0024; B67D 1/0018; B67D 1/0011; B67D 1/0006; B65D 51/1644; B65D 85/72; B65D 17/401; B65D 2205/02; B65D 2401/00; B65D 25/00; B65D 2205/00; B65D 2517/0094; B65D 77/225

See application file for complete search history.

(56) References Cited

U.S. PATENT DOCUMENTS

| | | | | |
|---|---|---|---|---|
| 4,989,746 | A * | 2/1991 | Pierce | B65D 51/007 220/815 |
| 5,415,312 | A * | 5/1995 | Mueller | B65D 47/089 222/545 |
| 5,651,471 | A * | 7/1997 | Green | B65D 47/243 222/545 |
| 2004/0040961 | A1 | 3/2004 | Vilalta | B65D 81/2038 220/203.23 |
| 2004/0099665 | A1 | 5/2004 | McEldowney | B65D 17/4011 220/276 |

(Continued)

*Primary Examiner* — Kareen K Thomas

(74) *Attorney, Agent, or Firm* — Jonas R. Mellang; Kelly, Holt & Christenson, P.L.L.C.

(57) ABSTRACT

A pressure actuated pressure relief valve is disposed in the body of a beverage vessel and is configured to be in fluidic communication with an exterior of the beverage vessel and an interior of the beverage vessel. The pressure actuated pressure relief valve being configured to actuate from a closed position to an open position based on pressure reaching a threshold within the interior of the beverage vessel. The pressure actuated pressure relief valve being configured to actuate from the open position to the closed position based on pressure falling below the threshold within the interior of the beverage vessel.

20 Claims, 29 Drawing Sheets

(56) References Cited

U.S. PATENT DOCUMENTS

| | | | | |
|---|---|---|---|---|
| 2010/0133275 | A1 | 6/2010 | Phillips | B65D 45/025 220/270 |
| 2013/0161325 | A1 | 6/2013 | Vanderstraeten | B21D 51/2653 413/2 |
| 2014/0070432 | A1 | 3/2014 | Tatera | B01F 23/23611 261/34.1 |
| 2016/0000246 | A1 | 1/2016 | Vanderstraeten | A47G 19/2272 220/714 |
| 2018/0362210 | A1 | 12/2018 | Vanderstraeten | B65D 17/4014 |
| 2021/0300644 | A1 | 9/2021 | Hirdler et al. | |

* cited by examiner

FIG. 5C
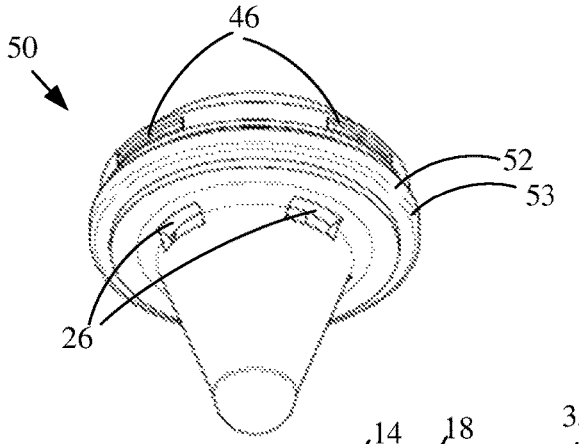
FIG. 5E
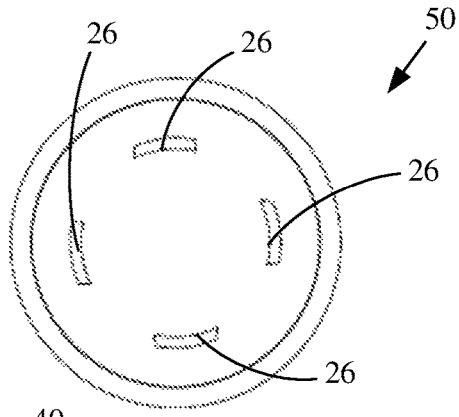
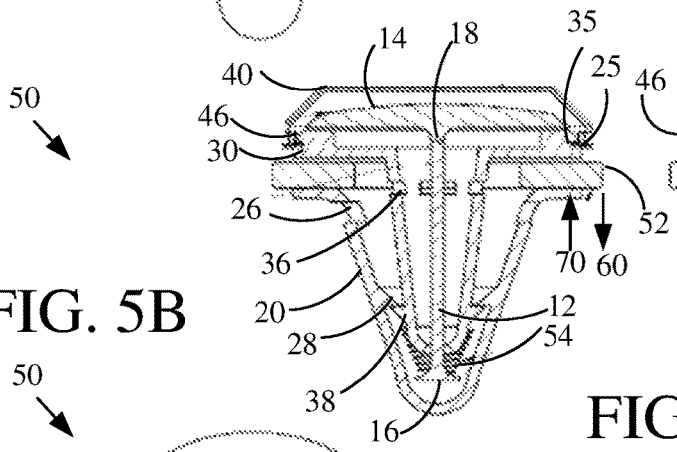
FIG. 5B
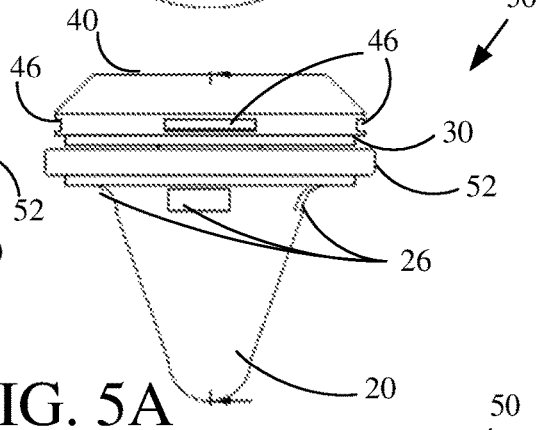
FIG. 5A
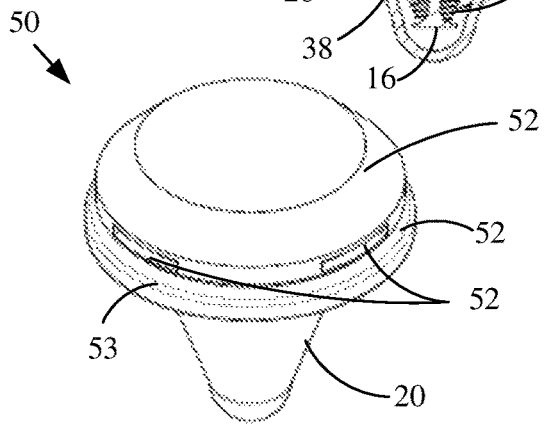
FIG. 5D
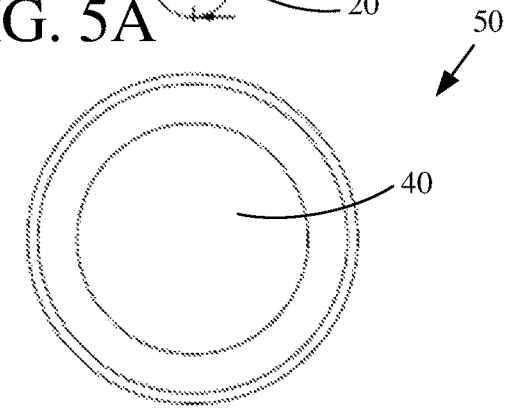
FIG. 5F

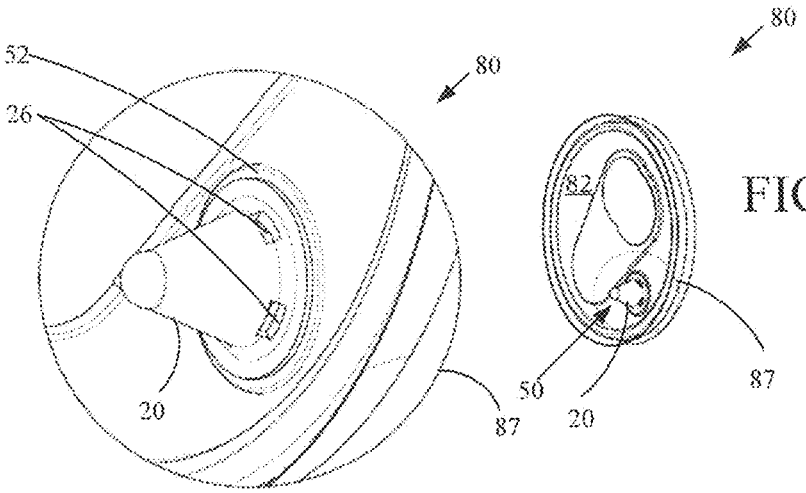
FIG. 6D
FIG. 6C
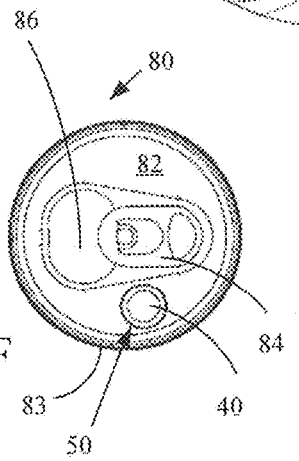
FIG. 6F
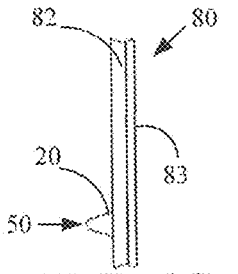
FIG. 6G
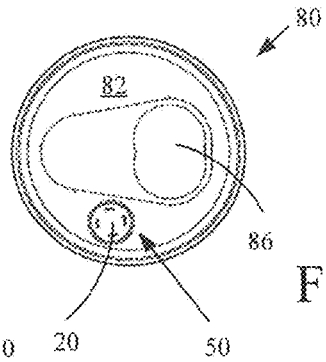
FIG. 6E
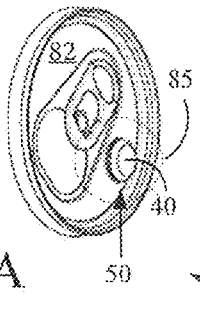
FIG. 6A
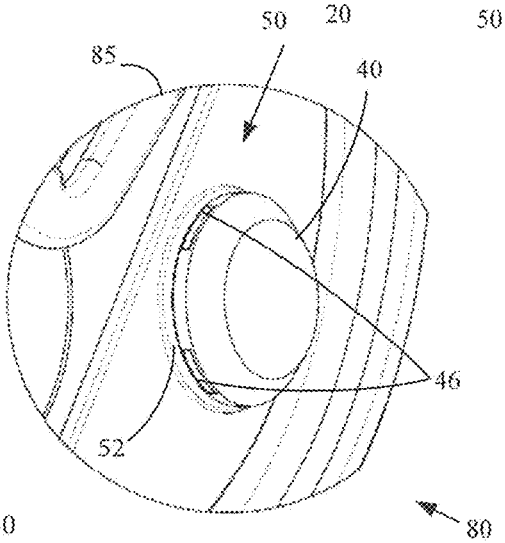
FIG. 6B FIG. 11E
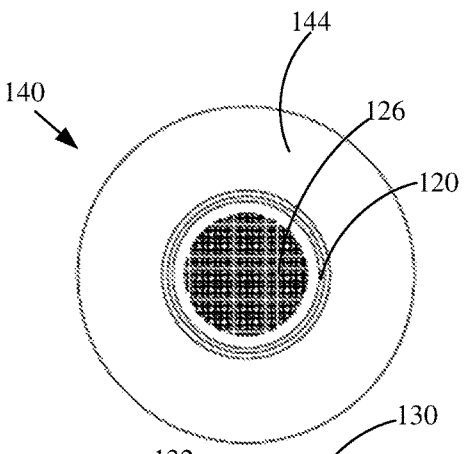
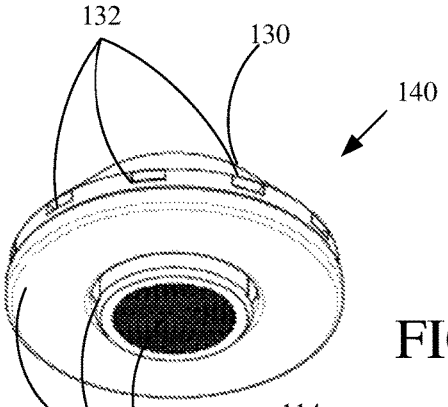
FIG. 11C
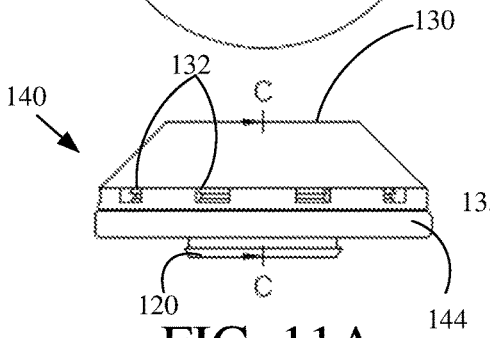
FIG. 11A
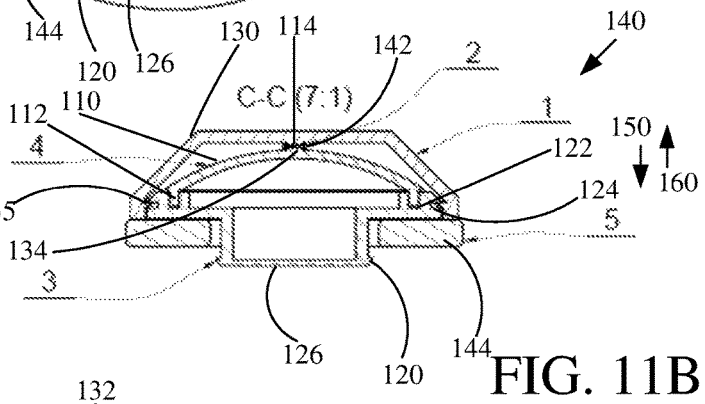
FIG. 11B
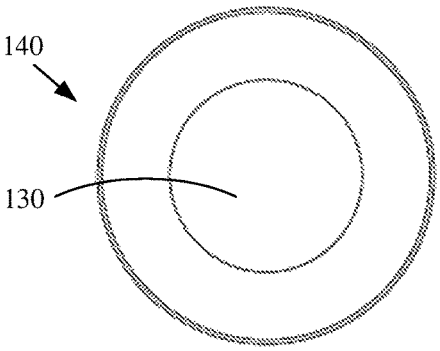
FIG. 11F
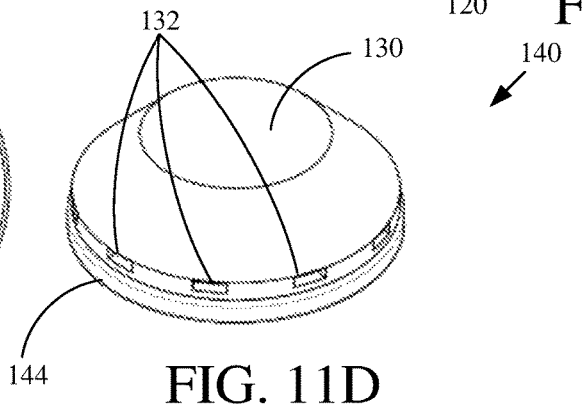
FIG. 11D FIG. 12A
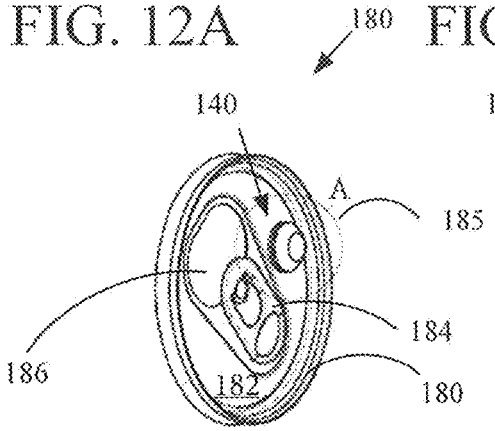
FIG. 12B
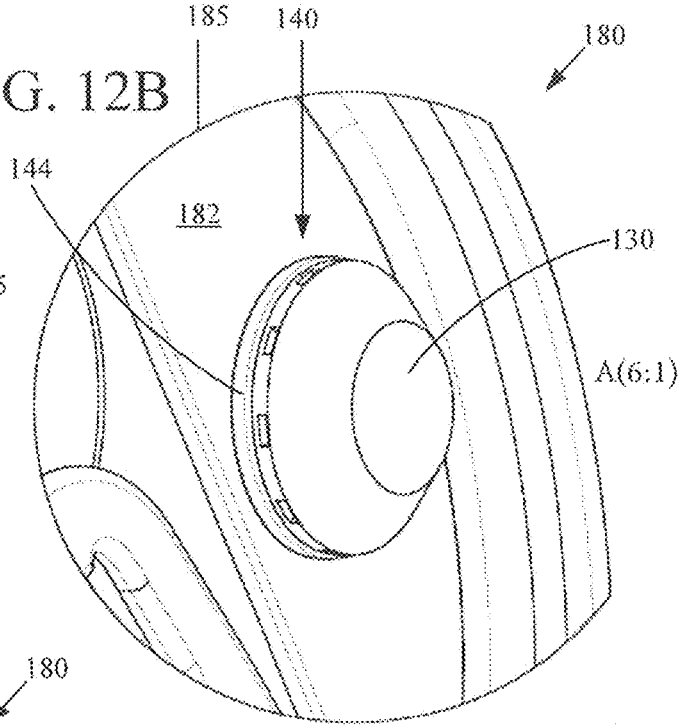
FIG. 12F
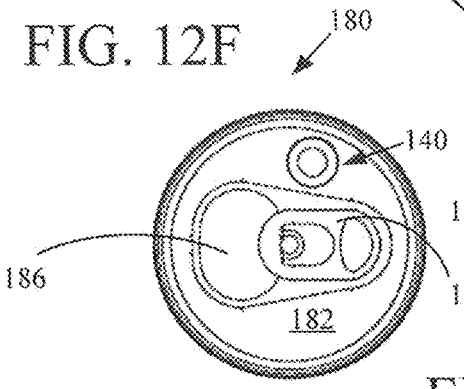
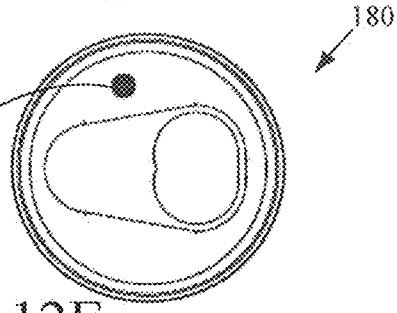
FIG. 12E
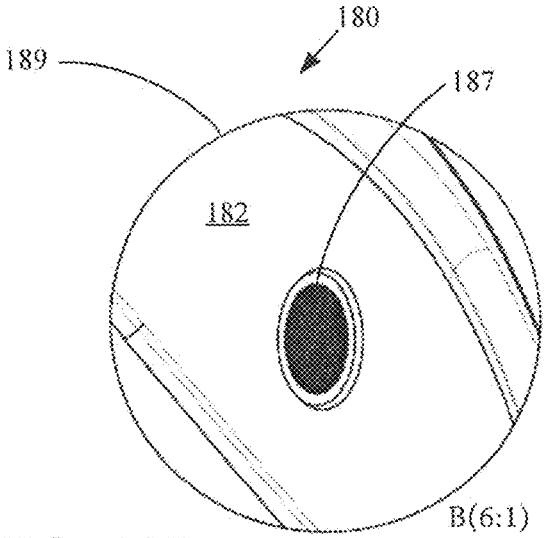
FIG. 12D
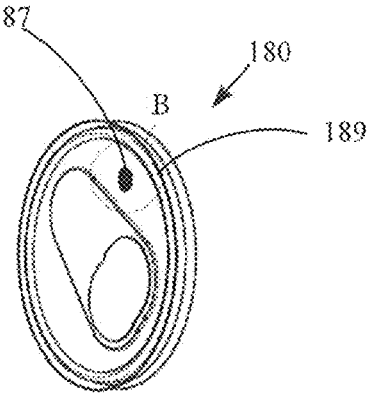
FIG. 12C

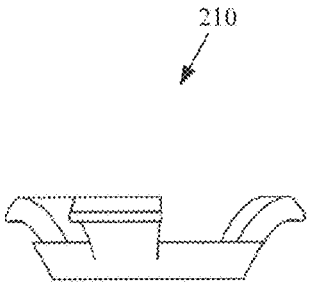
FIG. 14A
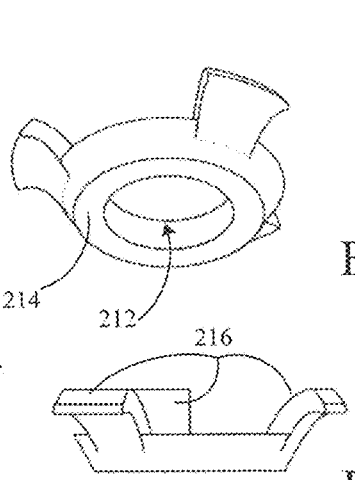
FIG. 14B
FIG. 14C
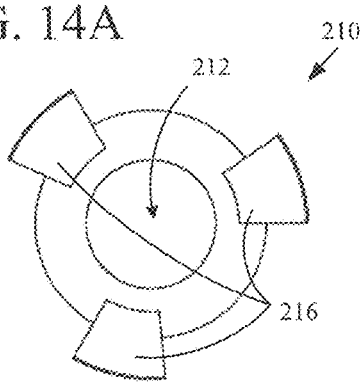
FIG. 14E
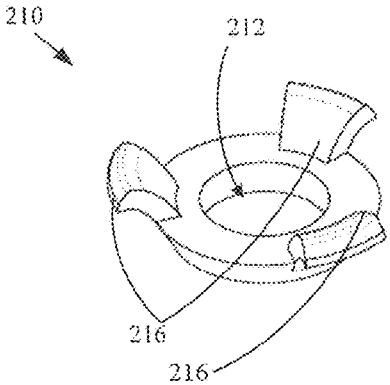
FIG. 14D FIG. 15A
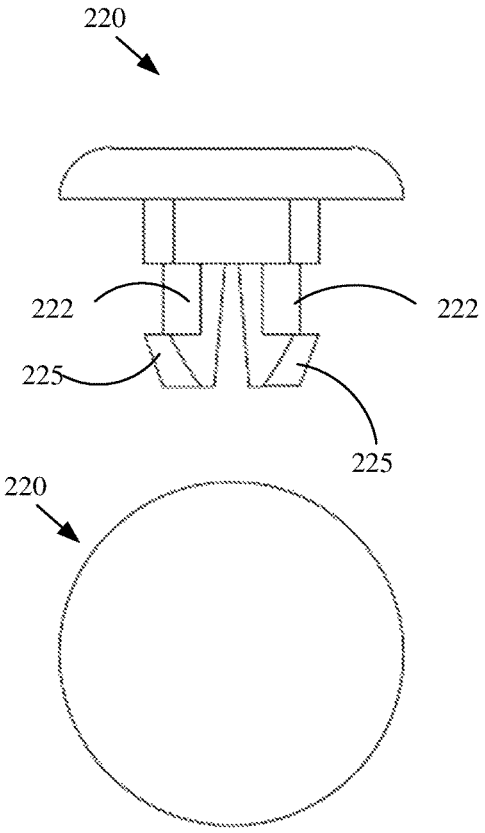
FIG. 15E
FIG. 15C
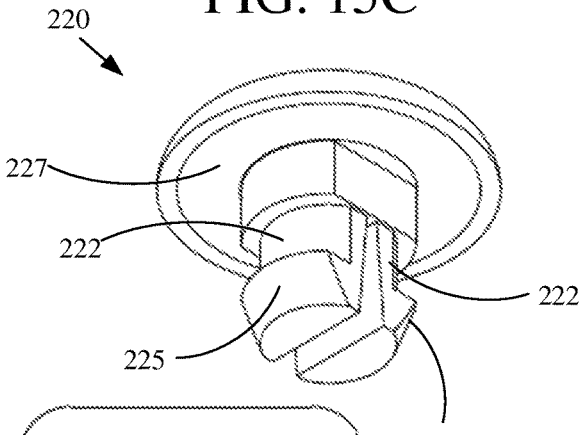
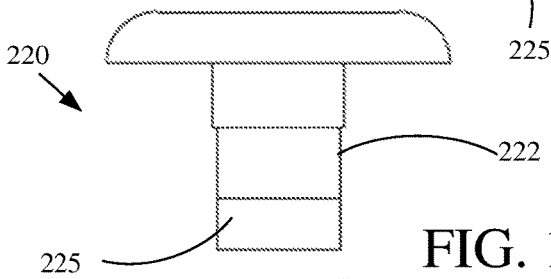
FIG. 15B
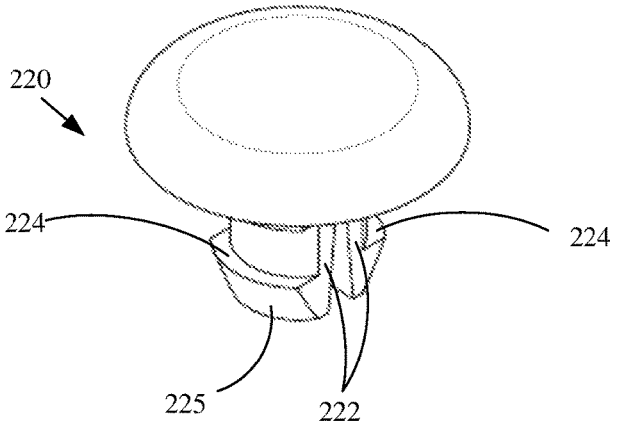
FIG. 15D

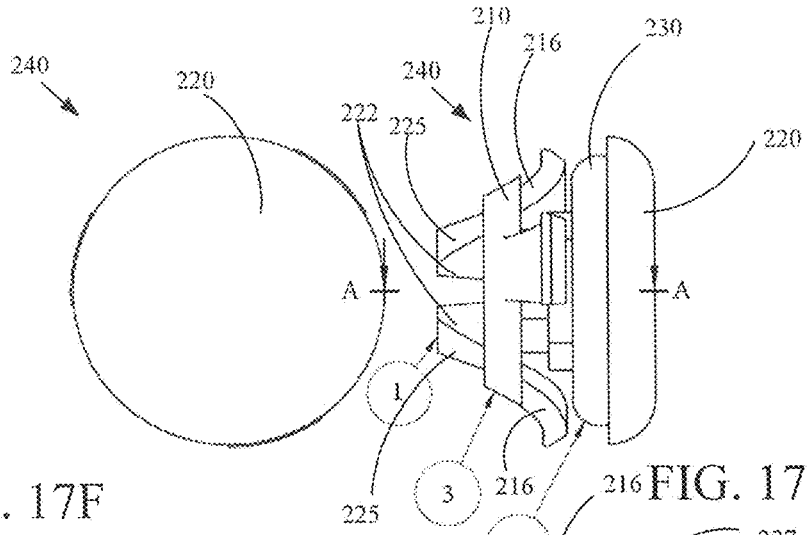
FIG. 17F
FIG. 17A
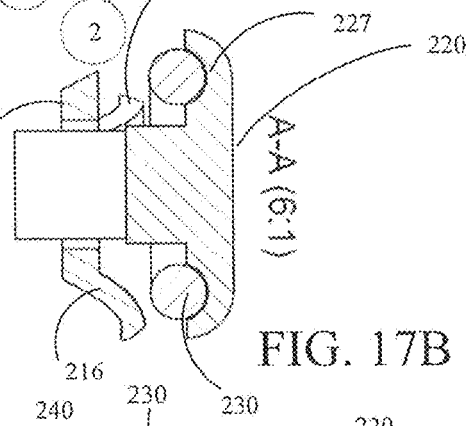
FIG. 17B
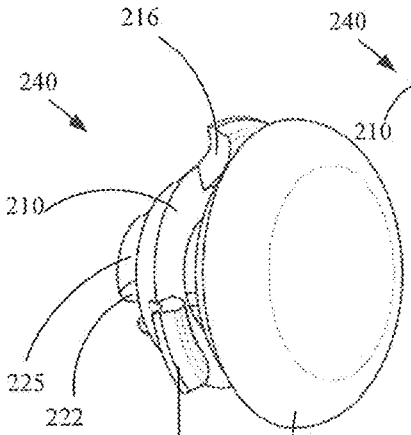
FIG. 17D
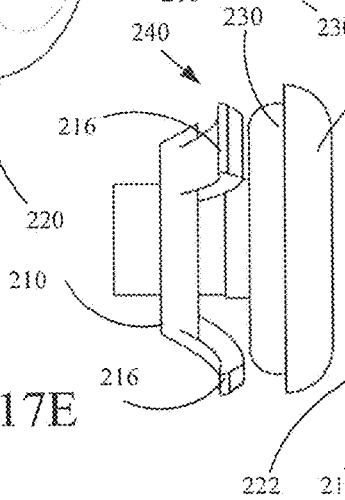
FIG. 17E
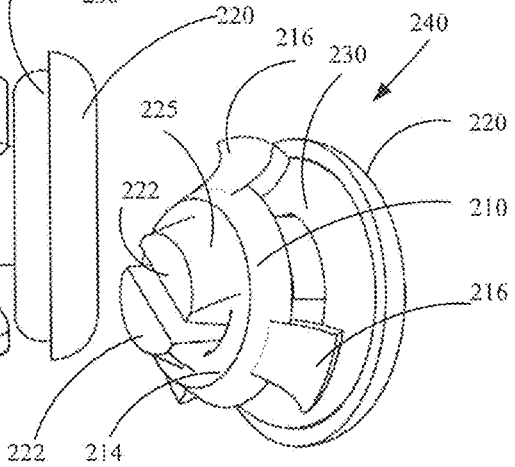
FIG. 17C FIG. 18D
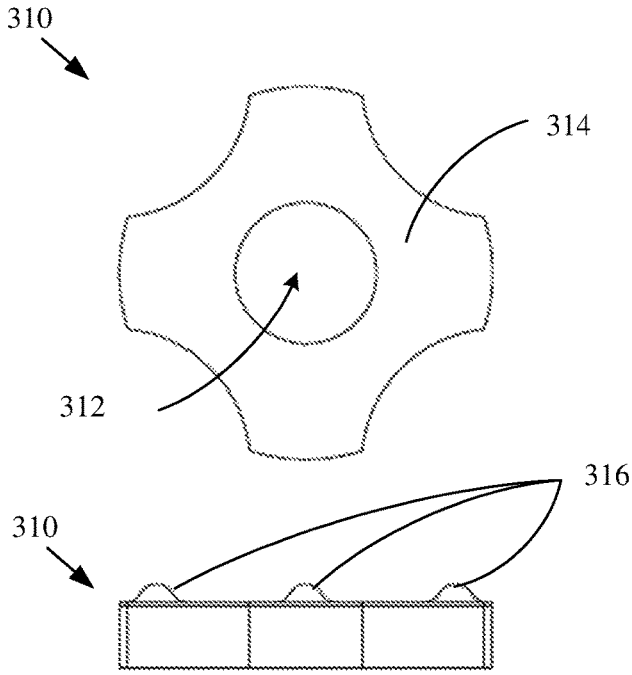
FIG. 18A
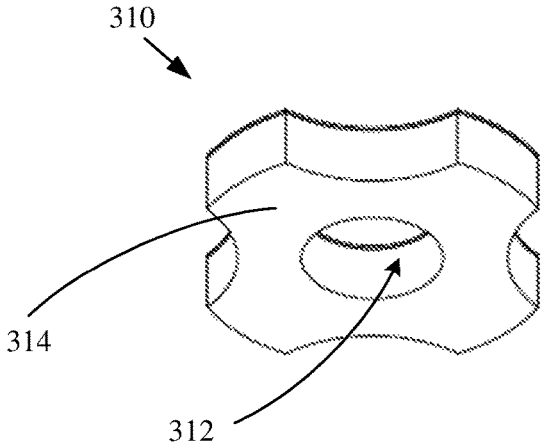
FIG. 18B
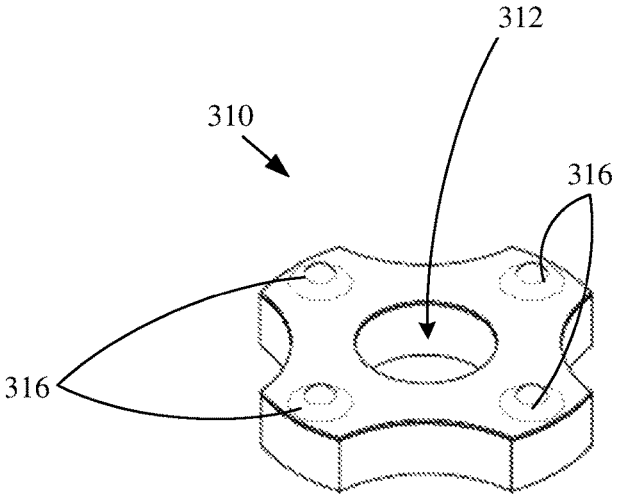
FIG. 18C FIG. 19D
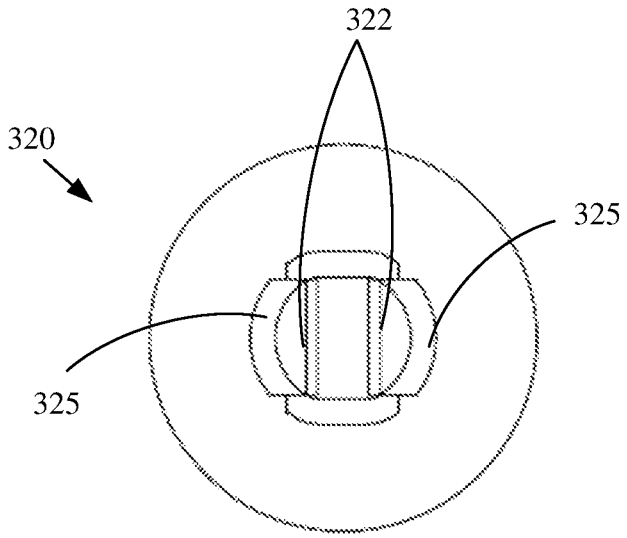
FIG. 19B
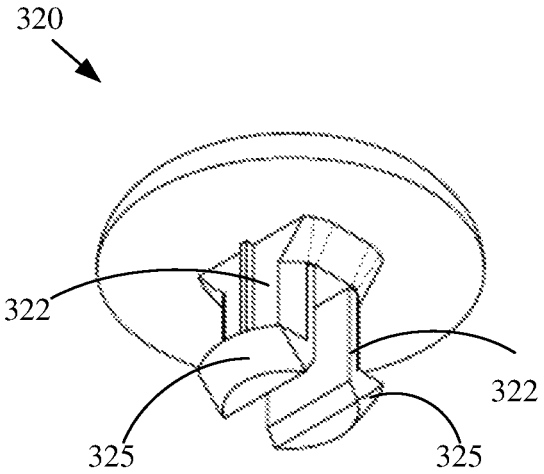
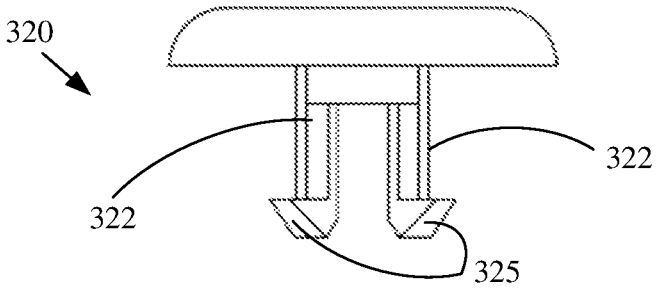
FIG. 19A
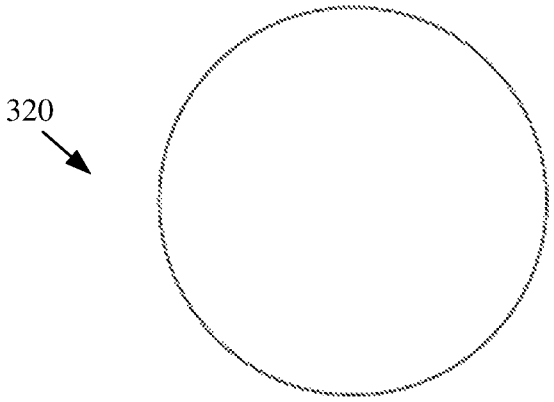
FIG. 19E
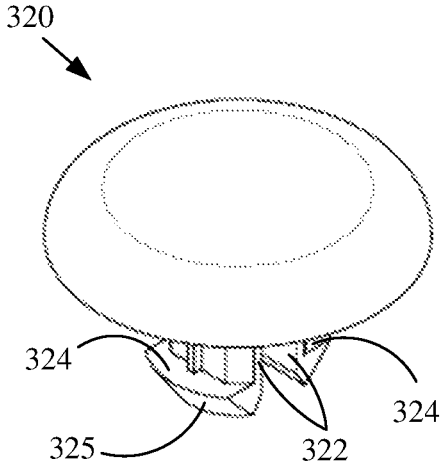
FIG. 19C

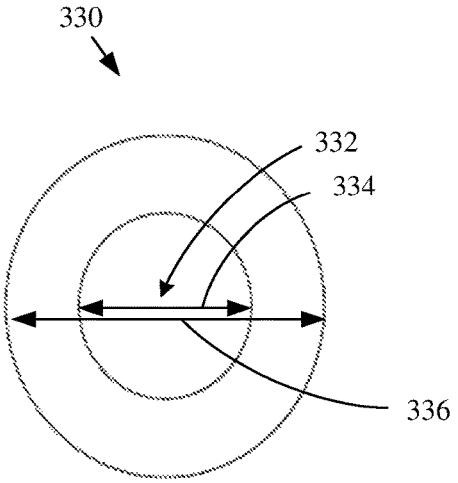
FIG. 20F
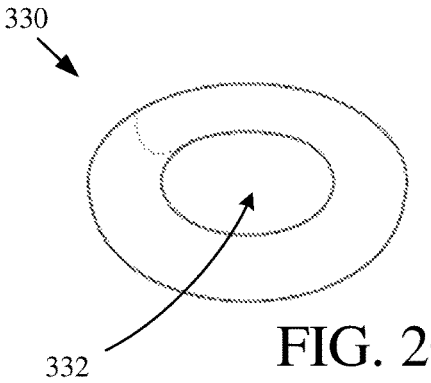
FIG. 20D
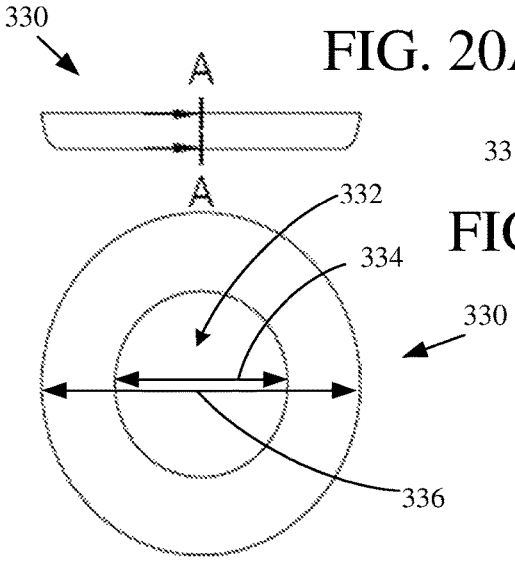
FIG. 20G
FIG. 20A
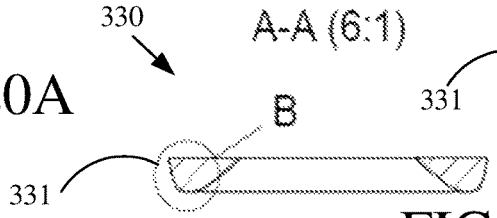
FIG. 20B
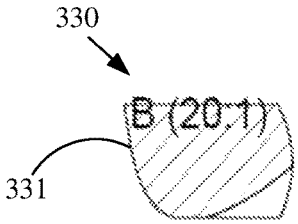
FIG. 20C
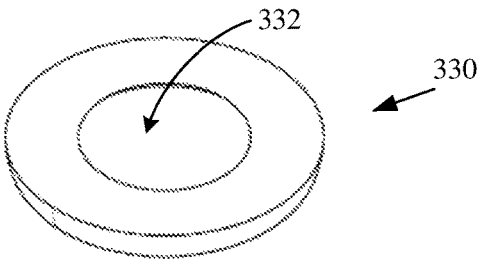
FIG. 20E

C-C (6:1) FIG. 21C

FIG. 25C
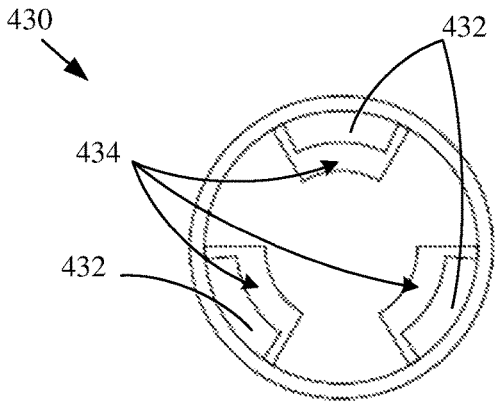
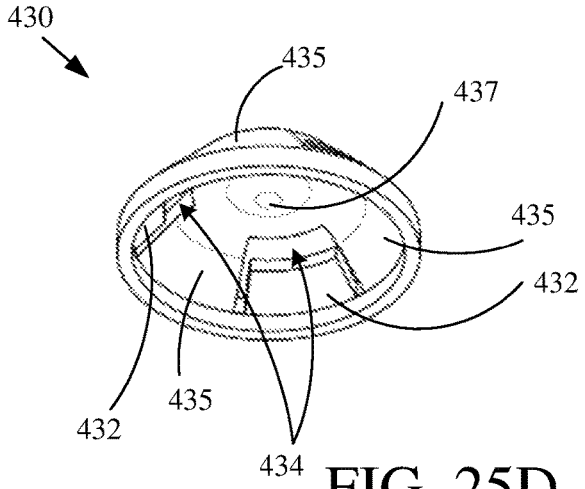
FIG. 25D
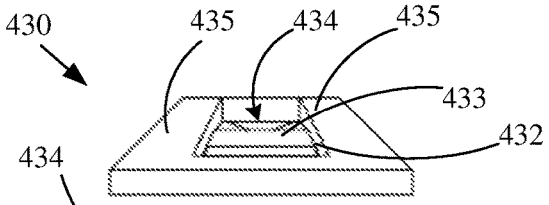
FIG. 25F
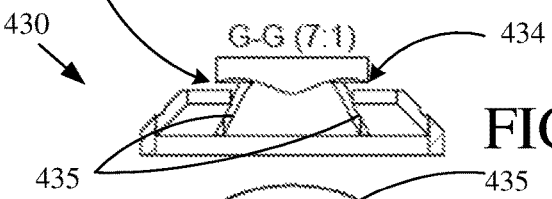
FIG. 25B
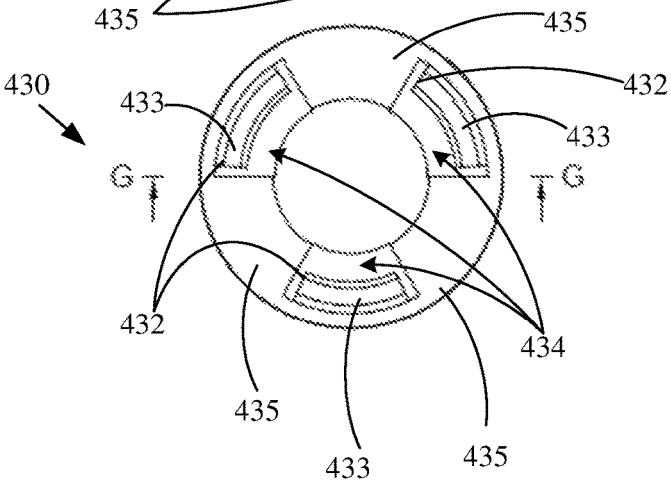
FIG. 25A
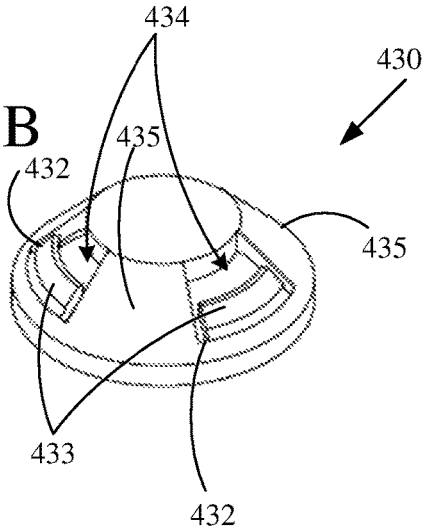
FIG. 25E

E-E(1:1)
F(7)
C(7:1)
A(7:1)
D(7:1)
B(7:1)

MECHANICAL PRESSURE RELIEF VALVE FOR USE IN LIVE BEVERAGES

CROSS-REFERENCE TO RELATED APPLICATIONS

The present application is a continuation of and claims priority of U.S. patent application Ser. No. 17/213,870, filed Mar. 26, 2021, which is based on and claims the benefit of U.S. provisional patent application Ser. No. 63/000,958, filed Mar. 27, 2020, the contents of which are hereby incorporated by reference in their entirety.

FIELD OF THE DESCRIPTION

The present description relates to pressure relief valves. More specifically, the present description relates to inert mechanical pressure relief valves for use in live beverage vessels to allow the bottling or canning of live beverages, such as live beer.

BACKGROUND

In the beverage industry, beverage producers produce various beverages and/or seal them in a variety of beverage vessels, for instance, seal the beverage in beverage cans during a canning process or seal the beverage in beverage bottles during a bottling process. Some beverage producers, such as beer producers, produce and/or seal live beverages, such as live beers, which include live yeast and culture, in various beverage vessels.

The discussion above is merely provided for general background information and is not intended to be used as an aid in determining the scope of the claimed subject matter.

SUMMARY

A pressure actuated pressure relief valve is disposed in the body of a beverage vessel and is configured to be in fluidic communication with an exterior of the beverage vessel and an interior of the beverage vessel. The pressure actuated pressure relief valve being configured to actuate from a closed position to an open position based on pressure reaching a threshold within the interior of the beverage vessel. The pressure actuated pressure relief valve being configured to actuate from the open position to the closed position based on pressure falling below the threshold within the interior of the beverage vessel.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

FIG. 5A is a side view showing one example pressure relief valve assembly.

FIG. 5B is a sectional view showing one example pressure relief valve assembly.

FIG. 5C is a perspective view showing one example pressure relief valve assembly.

FIG. 5D is a perspective view showing one example pressure relief valve assembly.

FIG. 5E is a bottom view showing one example pressure relief valve assembly.

FIG. 5F is a top view showing one example pressure relief valve assembly.

FIG. 6A is a perspective view showing one example beverage vessel end assembly.

FIG. 6B is an enlarged view showing one example portion of one example beverage vessel end assembly.

FIG. 6C is a perspective view showing one example beverage vessel end assembly.

FIG. 6D is an enlarged view showing one example portion of one example beverage vessel end assembly.

FIG. 6E is a bottom view showing one example beverage vessel end assembly.

FIG. 6F is a top view showing one example beverage vessel end assembly.

FIG. 6G is a side view showing one example beverage vessel end assembly.

FIG. 11A is a side view showing one example pressure relief valve assembly.

FIG. 11B is a sectional view showing one example pressure relief valve assembly.

FIG. 11C is a perspective view showing one example pressure relief valve assembly.

FIG. 11D is a perspective view showing one example pressure relief valve assembly.

FIG. 11E is a bottom view showing one example pressure relief valve assembly.

FIG. 11F is a top view showing one example pressure relief valve assembly.

FIG. 12A is a perspective view showing one example beverage vessel end assembly.

FIG. 12B is an enlarged view showing one example portion of one example beverage vessel end assembly.

FIG. 12C is a perspective view showing one example beverage vessel end assembly.

FIG. 12D is an enlarged view showing one example portion of one example beverage vessel end assembly.

FIG. 12E is a bottom view showing one example beverage vessel end assembly.

FIG. 12F is a top view showing one example beverage vessel end assembly.

FIG. 14A is a side view showing one example spring clip.

FIG. 14B is a side view showing one example spring clip.

FIG. 14C is a perspective view showing one example spring clip.

FIG. 14D is a perspective view showing one example spring clip.

FIG. 14E is a top view showing one example spring clip.

FIG. 15A is a perspective view showing one example sealing head.

FIG. 15B is a perspective view showing one example sealing head.

FIG. 15C is a perspective view showing one example sealing head.

FIG. 15D is a perspective view showing one example sealing head.

FIG. 15E is a top view showing one example sealing head.

FIG. 17A is a side view showing one example pressure relief valve assembly.

FIG. 17B is a sectional view showing one example pressure relief valve assembly.

FIG. 17C is a perspective view showing one example pressure relief valve assembly.

FIG. 17D is a perspective view showing one example pressure relief valve assembly.

FIG. 17E is a side view showing one example pressure relief valve assembly.

FIG. 17F is a top view showing one example pressure relief valve assembly.

FIG. 18A is a side view showing one example spring clip.

FIG. 18B is a perspective view showing one example spring clip.

FIG. 18C is a perspective view showing one example spring clip.

FIG. 18D is a bottom view showing one example spring clip.

FIG. 19A is a side view showing one example sealing head.

FIG. 19B is a perspective view showing one example sealing head.

FIG. 19C is a perspective view showing one example sealing head.

FIG. 19D is a bottom view showing one example sealing head.

FIG. 19E is a top view showing one example sealing head.

FIG. 20A is a side view showing one example sealing element.

FIG. 20B is a sectional view showing one example sealing element.

FIG. 20C is an enlarged view showing one example portion of one example sealing element.

FIG. 20D is a perspective view showing one example sealing element.

FIG. 20E is a perspective view showing one example sealing element.

FIG. 20F is a bottom view showing one example sealing element.

FIG. 20G is a top view showing one example sealing element.

FIG. 21C is a perspective view showing one example pressure relief valve assembly.

FIG. 24A is a perspective view showing one example valve housing.

FIG. 24B is a perspective view showing one example valve housing.

FIG. 24C is a bottom view showing one example valve housing.

FIG. 24D is a top view showing one example valve housing.

FIG. 24E is a side view showing one example valve housing.

FIG. 25A is a top view showing one example valve safety cap.

FIG. 25B is a sectional view showing one example valve safety cap.

FIG. 25C is a bottom view showing one example valve safety cap.

FIG. 25D is a perspective view showing one example valve safety cap.

FIG. 25E is a perspective view showing one example valve safety cap.

FIG. 25F is a side view showing one example valve safety cap.

FIG. 26A is a side view showing one example spring sealing element.

Figure 26D:
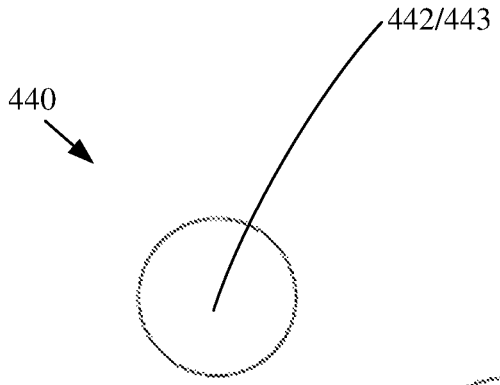
Figure 26B:
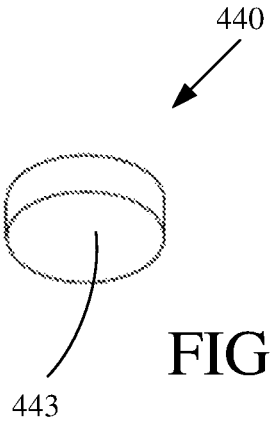

FIG. 26B is a perspective view showing one example spring sealing element.

Figure 26A:
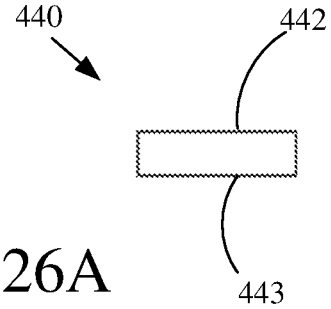
Figure 26C:
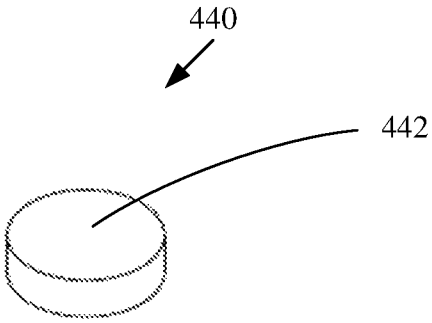

FIG. 26C is a perspective view showing one example spring sealing element.

FIG. 26D is a top or bottom view showing one example spring sealing element.

Figures 27A, 27B, 27C, 27D, 27E, 27F, 27G, 27H, 27I, 27J, 27K:
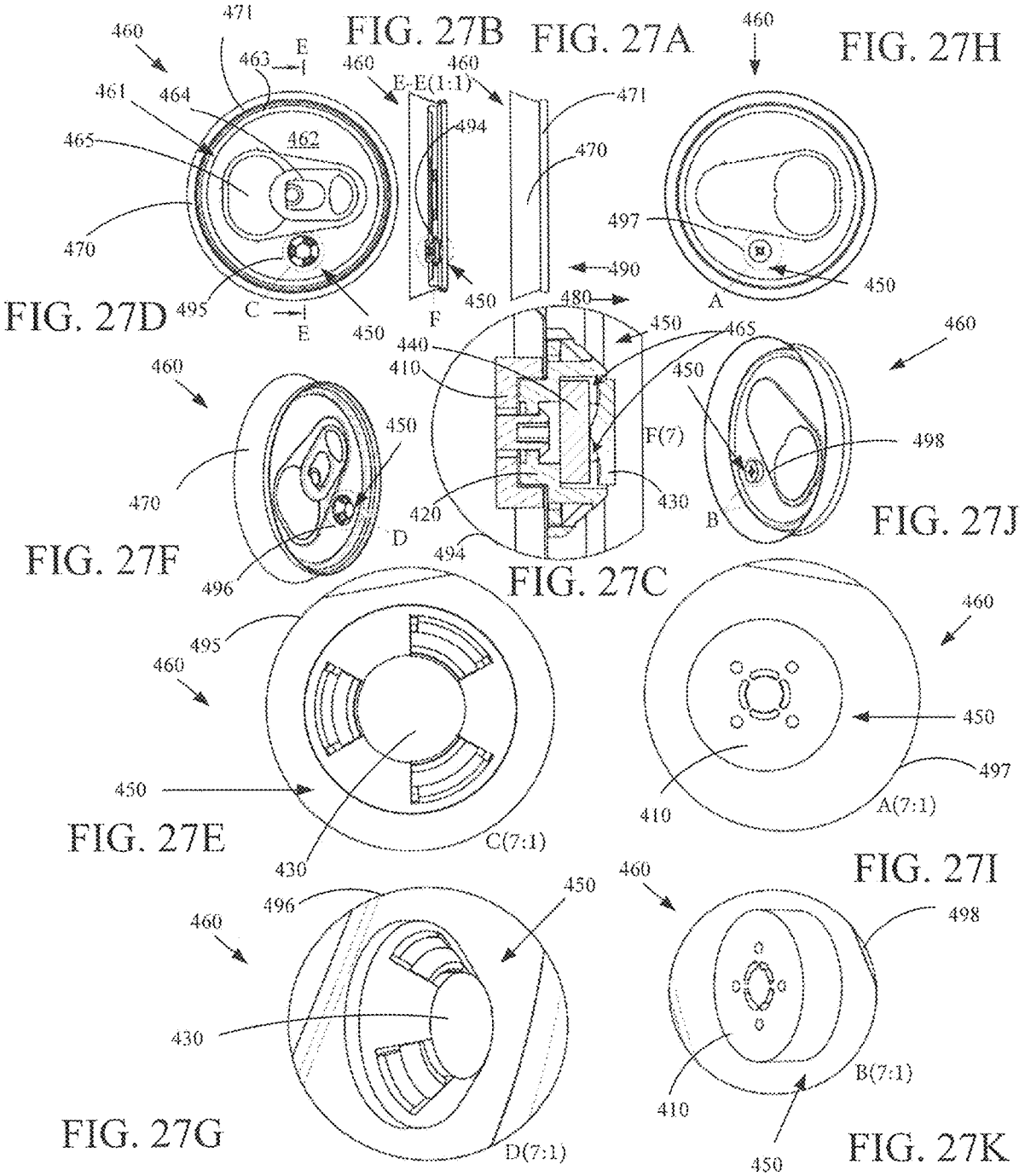

FIG. 27A is a side view showing one example beverage vessel assembly.

FIG. 27B is a side view showing one example beverage vessel assembly.

FIG. 27C is an enlarged sectional view showing one example portion of one example beverage vessel end assembly.

FIG. 27D is a top view showing example showing one example beverage vessel assembly.

FIG. 27E is an enlarged view showing one example portion of one example beverage vessel end assembly.

FIG. 27F is a perspective view showing one example beverage vessel assembly.

FIG. 27G is an enlarged view showing one example portion of one example beverage vessel end assembly.

FIG. 27H is a bottom view showing one example beverage vessel assembly.

FIG. 27I is an enlarged view showing one example portion of one example beverage vessel end assembly.

FIG. 27J is a perspective view showing one example beverage vessel assembly.

FIG. 27K is an enlarged view showing one example portion of one example beverage vessel end assembly.

Figure 28:
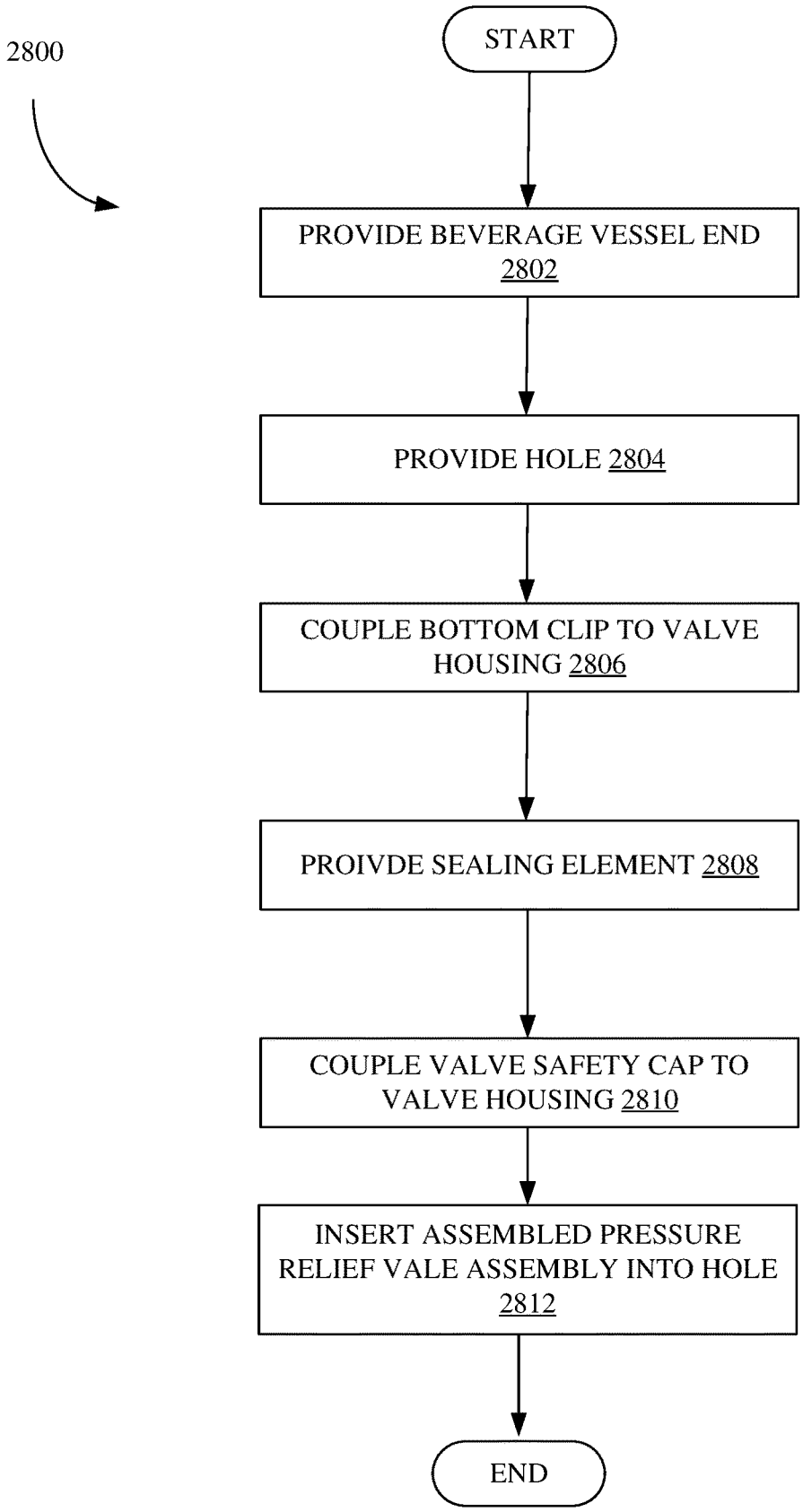

FIG. 28 is a flowchart showing one example method of assembling one example beverage vessel end assembly.

Figure 29A:
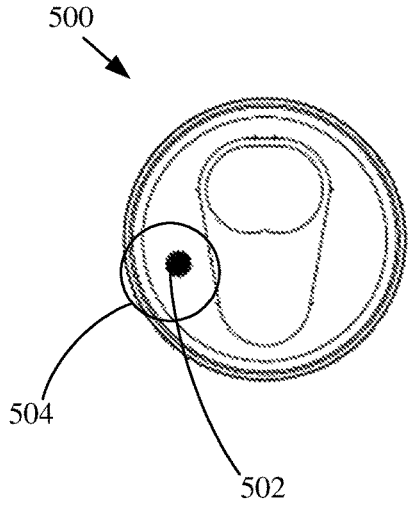

FIG. 29A is a top view showing one example beverage vessel end.

Figure 29B:
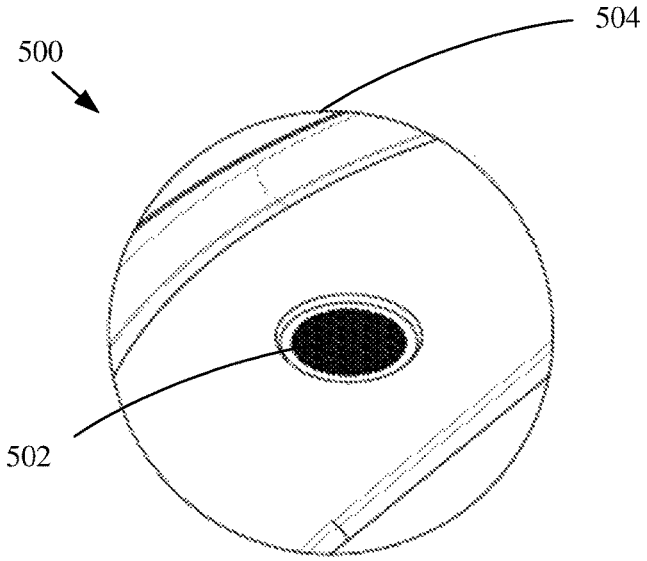

FIG. 29B is a bottom view showing one example beverage vessel end.

DETAILED DESCRIPTION

As described above, various beverage producers produce and/or seal live beverages, for instance, some beer producers produce and/or can and/or bottle live beers (e.g., beer with live yeast and culture). The use and/or production of live beers allows the producer to forego the pasteurization process. Additionally, live beers, when canned or bottled, can undergo a process sometimes referred to as conditioning (e.g., bottle conditioning, can conditioning, etc.) in which the live beverage continues to ferment while sealed in the beverage vessel. This conditioning can have desirable effects on the flavoring and carbonation of the live beverage, as well as other desirable effects. However, the live beverages produce, as a byproduct (e.g., through the fermentation process), a volume of gas(es) (e.g., carbon dioxide gas). With the live beverage being sealed in a beverage vessel, the volume of gas can increase in quantity and pressure to a point where the beverage vessel is comprised, possibly comprising the seal, the beverage vessel, and/or affecting the appearance of the beverage vessel.

Pressure relief valve assemblies can be used to relieve the pressure inside a vessel. However, available pressure relief valves are not suitable for use in the canning or bottling process, due to their size or expense, for example. Some beverage producers utilize rupture discs (also referred to as pressure safety discs, bursting discs, or bust diaphragms). However, rupture discs are non-reclosing, and thus non-reusable, devices. Additionally, rupture discs can only accommodate a certain volume of gas produced by a live beverage. Further, once ruptured, the beverage vessel is compromised such that the product is defective and there is access to the live beverage, which could allow contamination and/or other effects.

Described herein are various embodiments of pressure actuated pressure relief valve assemblies suitable for use in the bottling and/or canning of live beverages, such as live beers. The various pressure actuated pressure relief valve assemblies described herein are re-usable (e.g., resealing, reclosing, etc.). The various pressure actuated pressure relief valve assemblies described herein can be formed of inert (e.g., non-reactive with the live culture beverage, such as no chemical reaction with the live culture beverage), United States Food and Drug Administration (FDA) approved food grade materials in whole (e.g., every individual components of the pressure relief valve assembly is formed of FDA approved food grade material) or in part (e.g., individual components can be formed of FDA approved food grade materials while other components are not). Being inert and comprising FDA approved food grade material, the various pressure actuated pressure relief valve assemblies described herein allow for safe consumption of the live beverage and will not produce undesired flavors. The various pressure actuated pressure relief valve assemblies and their individual components, described herein, are scalable for use in a variety of bottling and/or canning applications, with a variety of different beverage vessels, configured to contain a variety of different volumes of live beverages. The various pressure actuated beverage relief valve assemblies described herein do not compromise the structure of the various beverage vessels and/or various beverage vessel ends with which they are incorporated. The various pressure actuated pressure relief valve assemblies described herein can be low profile such that they do not interfere with the stacking of beverage vessels, such as the stacking of beverage cans. In addition, the various pressure actuated pressure relief valve assemblies described herein can include one or more tamper features, such as a tamper-evident mechanism or feature which alert a consumer of attempted tampering with the respective pressure relief valve assembly, and/or a tamper inhibiting mechanism or feature which seeks to prevent and/or eliminate tampering with and/or compromising the pressure actuated pressure relief valve, such as tampering or compromising the seal.

The various pressure actuated pressure relief valve assemblies and/or their components can be molded bodies (e.g., formed during a molding process, such as injection molding). In some examples, some individual components may not be molded, but are otherwise provided and/or coupled to other components of the various pressure relief valve assemblies.

The various pressure actuated pressure relief valve assemblies described herein provide for the relief of pressure (e.g., from the buildup of gas(es) produced by a live beverage within a beverage vessel) after a live beverage has been sealed (e.g., canned, bottled, etc.) inside a beverage vessel (e.g., can, bottle, etc.). The various pressure actuated pressure relief valve assemblies described herein can have a set resistance, which can be varied for suitability with various applications, such that the pressure of the gas(es) internal to the beverage vessel will be relieved prior to compromise of the beverage vessel. The various pressure actuated pressure relief valve assemblies described herein can be installed into an aperture (e.g., hole) in a beverage vessel end (e.g., lid, top, cap, etc.) and will not inhibit the bottling or canning process, nor will they inhibit the consumption of the beverage. Additionally, the various pressure actuated pressure relief valve assemblies described herein can be incorporated with standard and/or already-in-use beverage vessels (or components thereof) suitable in the beverage production industry.

While various pressure actuated pressure relief valve assemblies described herein are described with reference to a beverage can, such as a beer can, and a beverage can end (e.g., lid, top, cap, etc.), such as beer can lid, it should be understood that the various embodiments described herein are scalable and suitable for use with a variety of other beverage vessels such as beverage bottles (e.g., plastic bottles, glass bottles, aluminum bottles, etc.), as well as a variety of other beverage vessel ends such as compression bottle caps and screw bottle caps. Further, the various pressure actuated pressure relief valve assemblies described herein are suitable for use with a variety of beverage vessels and/or beverage vessel ends formed of a variety of materials, such as metal (e.g., aluminum) or polymer (e.g., plastic). Additionally, while the various pressure actuated pressure relief vale assemblies herein are described as being disposed in a beverage vessel end (e.g., lid, top, cap, etc.), in other example, the various pressure actuated pressure relief valve assemblies herein can be disposed in other portions of a beverage vessel body such as a sidewall (e.g., cylindrical sidewall) of the beverage vessel, or another end of the beverage vessel (e.g., a bottom end of the beverage vessel).

FIGS. 1A-6F illustrate one example embodiment of a pressure actuated pressure relief valve. With reference first to FIGS. 6A-G, FIGS. 6A-G show various views of beverage end assembly 80 including a pressure relief valve assembly 50. FIG. 6A is a perspective view showing one example beverage vessel end assembly 80. FIG. 6B is an enlarged view showing portion 85 of beverage vessel lid assembly 80. FIG. 6C is a perspective view showing beverage vessel lid assembly 80. Those skilled in the art will appreciate that FIG. 6C illustrates the bottom side and/or underside of lid 82. FIG. 6D is an enlarged view showing portion 87 of beverage vessel end assembly 80. FIG. 6E is a bottom view showing beverage vessel end assembly 80. FIG. 6F is a top view showing beverage vessel end assembly 80. FIG. 6G is side view showing beverage vessel end assembly 80.

Beverage vessel end assembly 80 includes lid 82, tab 84, mouth 86, and pressure relief valve assembly 50. Those skilled in the art will appreciate that FIG. 6A illustrates the top side of lid 82. Lid 82, itself, includes rim 83. As illustrated, pressure relief valve assembly 50 is installed into lid 82 at a position between tab 84 and/or mouth 86 and rim 83. As can also be seen, in one example, pressure relieve valve assembly 50 has a height less than the height of rim 83. While the dimensionality and placement of pressure relieve valve assembly 50 can be varied, in one example, pressure relief valve assembly 50 is configured such that it does not restrict or otherwise interfere with the stacking of beverage vessels, such as beverage cans, for instance, in one example, valve assembly 50 is placed far enough away from rim 83 and has a low enough height (e.g., lower than rim 83) such that another beverage vessel (e.g., beverage vessel can) can be stacked on top of the beverage vessel of which lid 82 is a part.

With reference next to FIGS. 5A-F, FIGS. 5A-F show various views of pressure relief valve assembly 50. FIG. 5A is a side view showing pressure relief valve assembly 50. FIG. 5B is a sectional view showing pressure relieve valve assembly 50 at line A-A shown in FIG. 5A. FIG. 5C is a perspective view showing pressure relief valve assembly 50. FIG. 5D is a perspective view showing pressure relief valve assembly 50. FIG. 5E is a bottom view showing pressure relief valve assembly 50. FIG. 5F is a top view showing pressure relief valve assembly 50.

Pressure relief valve assembly 50 includes valve stem and valve head assembly 10, valve female housing 20, valve male housing 30, valve safety cap 40, sealing element 52, and spring element 54. Sealing element 52 provides a fluid-tight seal between the interior and exterior of the beverage vessel in which pressure relief valve assembly 50 is installed. In one example, sealing element 52 is a grommet. In other examples, sealing element 50 can be a variety of other type of sealing elements, such as an O-ring, a gasket, a sealing washer, as well as various other suitable sealing elements. In one example, sealing element 52 is formed of inert and/or FDA approved food grade material(s). Sealing element 52 can be of variable dimension to accommodate various different beverage vessels. While a single sealing element is shown in FIG. 5B, it is to be understood that in other examples, pressure relief valve assembly 50 can include more than one sealing element 52, for instance, one sealing element 52 on the top side (e.g., configured to contact the top side) of the beverage vessel end (e.g., lid, top, cap, etc.) and another sealing element 52 on the bottom side (e.g., configured to contact the bottom side) of the beverage vessel end.

As illustrated, pressure relief assembly 50 further includes spring element 54. In the illustrated example, spring element 54 is a coiled spring, though, in other examples, spring element 54 can be a variety of other suitable spring elements, such as leaf spring(s). Spring element 54 can be of variable resistance and variable dimension for suitability with a variety of applications, such as a variety of different beverage vessels. In one example, spring element 54 is formed of inert and/or FDA approved food grade material. In some examples, the elasticity of one or more components of pressure relief valve assembly 50 can replace spring element 54 or help provide, in addition to spring element 54, spring force, for instance, in one example, valve stem 12 can have an elasticity that provides a spring force to drive movement of valve head 14 between a valve open position and a valve closed position.

When pressure relief valve assembly 50 is assembled, as shown in FIG. 5B, spring 54 bears against tapered end 16 of valve stem 12 and an end of valve male housing 30. Spring 54 has a set resistance that naturally biases valve stem 12 and thus assembly 10, in the direction indicated by arrow 60, to a valve closed position wherein valve head 14 is seated in recess 36 thus preventing the flow of fluid to an exterior of pressure relief valve assembly 50. While contained in the beverage vessel, the live beverage ferments and releases a volume of gas(es) as a natural byproduct. The gas(es) can be exposed to interior of pressure relief valve assembly 50 via inlets 26 and 36, whereby the pressure of the gas volume can bear against items of pressure relief valve assembly 50. As more gas is produced the pressure of the gas volume will increase and continue to bear against items of valve assembly 50 until its force overcomes the resistance force of spring 54. In response, spring 54 will compress, or otherwise actuate, and a valve driving movement will result, in which valve stem 12, and thus assembly 10, is driven in the direction indicated by arrow 70 to a valve open position in which valve head 14 is unseated from recess 36. In the valve open position, fluid (e.g., gas(es) produced by live beverage) can escape to an exterior of pressure relief valve assembly 50 through outlets 45, thereby relieving (e.g., reducing) the interior pressure within the beverage vessel. Once the pressure has reduced sufficiently, the resistance force of the spring will overcome the force of the interior pressure and thereby drive valve stem 12, and thus assembly 10, back to a valve closed position in the direction indicated by arrow 60, thereby preventing further flow of fluid to the exterior of pressure relief valve assembly 50. In some examples, to set relief pressure, the spring constant of spring 54 and/or surface area of valve head 14 can be adjusted.

As shown in FIGS. 5C and 5D, sealing element 52 includes a mating feature 53, such as a groove or slot, that is configured to receive a portion of a beverage vessel end (e.g., lid, top, cap, etc.). In this way, sealing element can be securely disposed on an interior and exterior of the beverage vessel.

Though not shown in the FIGS., it will be noted that pressure relief valve assembly 50 can further include a screen that can be placed on an exterior or interior of valve female housing 20, for example, in front of or behind inlets 26. The screen may be impermeable to liquid but permeable to gas (such as the gas(es) produced by a live beverage), thereby preventing liquid from accessing an interior of valve assembly 50 but allowing gas to access an interior of valve assembly 50. The screen arrests the development of debris buildup (which may be carried by the liquid beverage) within valve assembly 50. Debris buildup can, in some examples, affect (e.g., prevent or interfere with valve driving movement, block and/or clog inlets, etc.) the normal functioning of valve assembly 50. The screen can be made of inert and/or FDA approved food grade material(s).

Figure 1C:
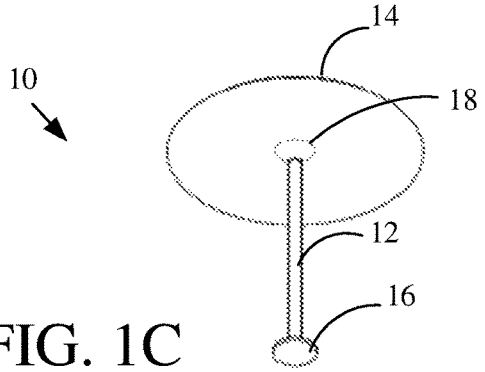
FIG. 1C is a perspective view showing one example valve stem and valve head assembly.
Figure 1E:
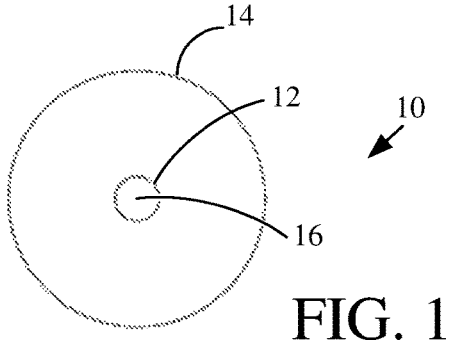
FIG. 1E is bottom view showing one example valve stem and valve head assembly.
Figure 1B:
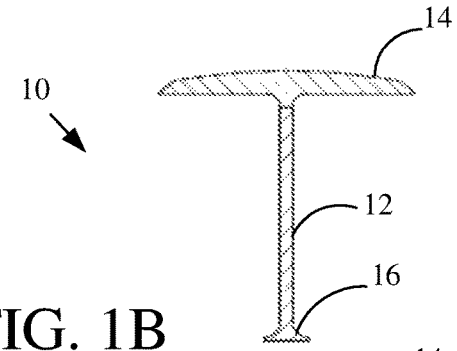
FIG. 1B is a sectional view showing one example valve stem and valve head assembly.
Figure 1A:
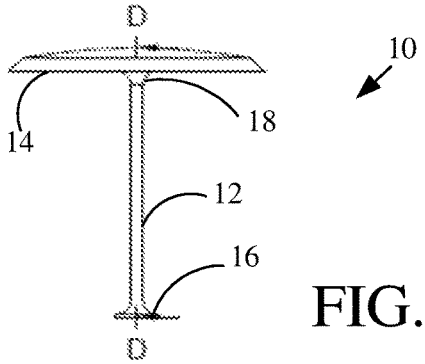
FIG. 1A is a side view showing one example valve stem and valve head assembly.
Figure 1D:
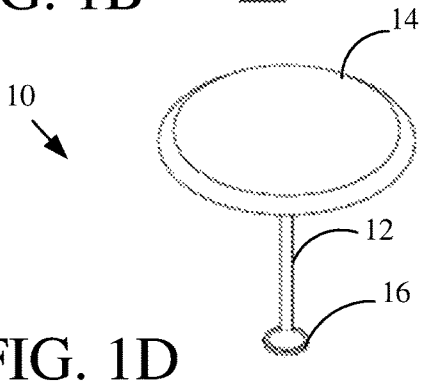
FIG. 1D is a perspective view showing one example valve stem and valve head assembly.
Figure 1F:
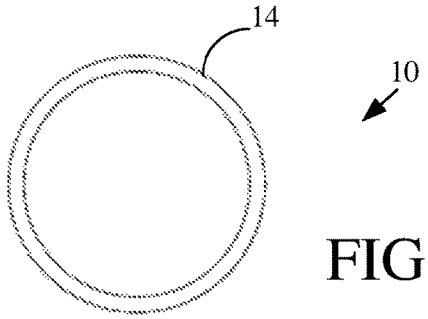
FIG. 1F is a top view showing one example valve stem and valve head assembly.

FIGS. 1A-F show various views of a valve stem and valve head assembly. FIG. 1A is a side view showing valve stem and valve head assembly 10. FIG. 1B is a sectional view showing valve stem and valve head assembly 10 at line D-D shown in FIG. 1A. FIG. 1C is a perspective view showing valve stem and valve head assembly 10. FIG. 1D is a perspective view showing valve stem and valve head assembly 10. FIG. 1E is a bottom view showing valve stem and valve assembly 10. FIG. 1F is a top view showing valve stem and valve head assembly 10.

Assembly 10 includes valve stem 12 and valve head 14. Valve stem 12, itself, includes a tapered end 16 which forms a surface for a spring such that the spring is retained on valve stem 12 and can bear against valve stem 12 (e.g., bear against surface of tapered end 16) to drive movement of assembly 10. In one example, valve stem 12 is a molded body formed of inert and/or FDA approved food grade material(s). Valve stem 12 can be of variable dimension (e.g., length) to accommodate various beverage vessels having various dimensions (e.g., thicknesses). Valve head 14, itself, includes a protrusion 18. In one example, valve head 14 is a molded body formed of inert and/or FDA approved food grade material(s). Valve head 14 can be of variable dimension to accommodate various different beverage vessels having various dimensions. As illustrated in FIG. 1A valve stem 12 and valve head 14 are coupled between an end of valve stem 12 and protrusion 18 of valve head 14. In one example, the end of valve stem 12 and protrusion 18 can form a mating pair (e.g., female and male). In other examples, the end of valve stem 12 and protrusion 18 are attached in other ways, such as by welding (e.g., sonic welding), or the use of adhesives. Other coupling techniques are also contemplated herein.

Figure 2C:
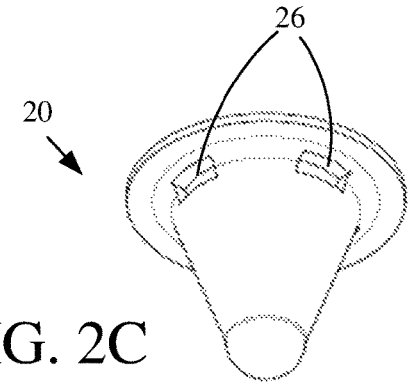
FIG. 2C is a perspective view showing one example valve female housing.
Figure 2E:
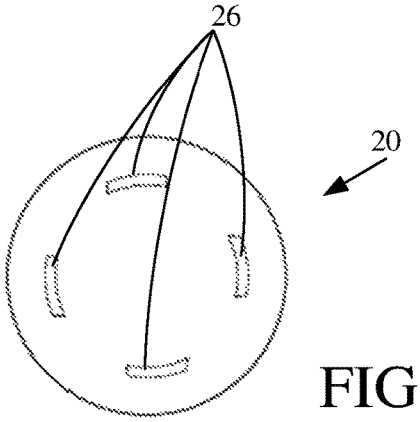
FIG. 2E is a bottom view showing one example valve female housing.
Figure 2B:
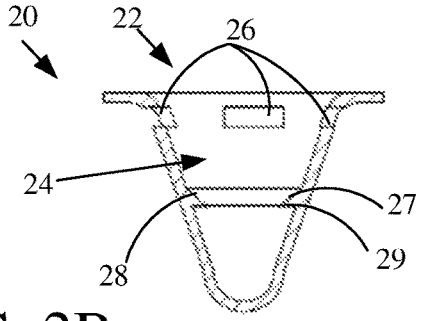
FIG. 2B is a sectional view showing one example valve female housing.
Figure 2A:
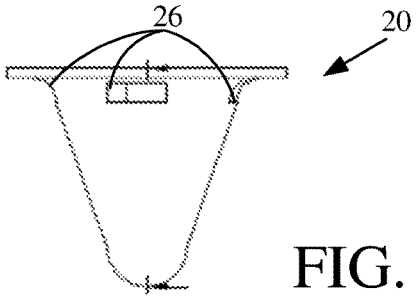
FIG. 2A is a side showing one example valve female housing.
Figure 2D:
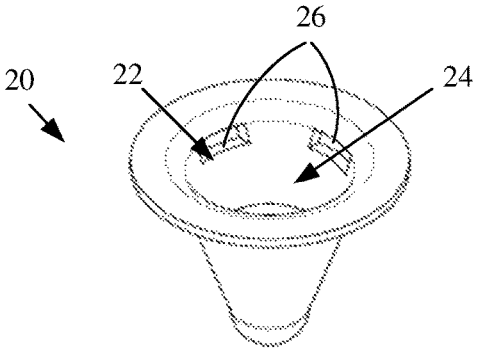
FIG. 2D is a perspective view showing one example valve female housing.
Figure 2F:
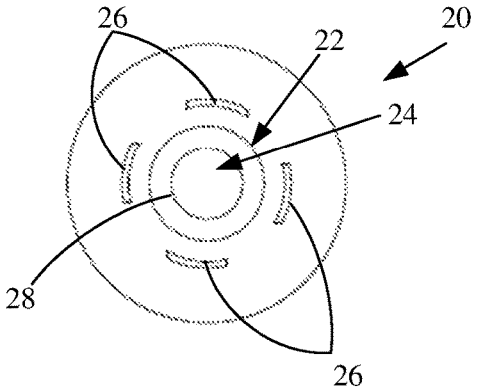
FIG. 2F is a top view showing one example valve female housing.

FIGS. 2A-F show various views of a valve female housing. FIG. 2A is a side view showing valve female housing 20. FIG. 2B is a sectional view showing valve female housing 20 at the line E-E shown in FIG. 2A. FIG. 2C is a perspective view showing valve female housing 20. FIG. 2D is a perspective view showing valve female housing 20. FIG. 2E is a bottom view showing valve female housing 20. FIG. 2F is a top view showing valve female housing 20.

As illustrated in FIG. 2A, valve female housing 20, itself, includes one or more inlets 26. While more than one inlet 26 is shown, it is to be understood that in other examples, valve female housing 20 may include more inlets or less inlets, such as only a single inlet 26. Inlets 26 provide a fluid pathway, such as pathway for fluid to an interior of valve female housing 20.

As illustrated in FIG. 2B, valve female housing 20 further includes opening 22, cavity 24, and a locking feature 28. As illustrated, valve female housing 20 includes an opening 22 at an end which provides access to cavity 24. Cavity 24 is configured to receive other items of a valve assembly. Valve female housing 20 further includes a locking feature 28. Locking features 28 provides for the coupling and retention of other items with valve female housing 20. In the illustrated example, locking features 28 is a tapered protrusion formed in the body (e.g., formed in the interior wall) of valve female housing 20. Locking feature 28, itself, includes ramp 27 and shoulder 29. Valve female housing 20 can be of variable dimension to accommodate various different beverage vessels having various dimensions. In one example, valve female housing 20 is a molded body formed of inert and/or FDA approved food grade material(s). In one example, valve female housing 20 is configured to be seated on the interior (e.g., below the beverage vessel end, such as the beverage vessel cap, lid, top, etc.) of a beverage vessel, such as a beverage can (e.g., beer can) or a beverage bottle (e.g., beer bottle).

Figure 3C:
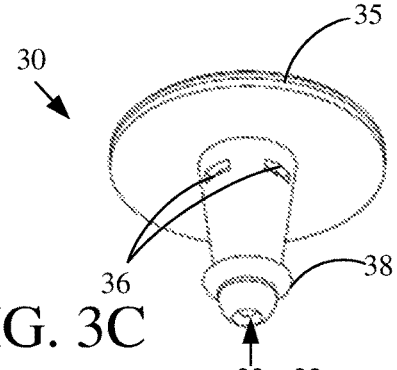
FIG. 3C is a perspective view showing one example valve male housing.
Figure 3E:
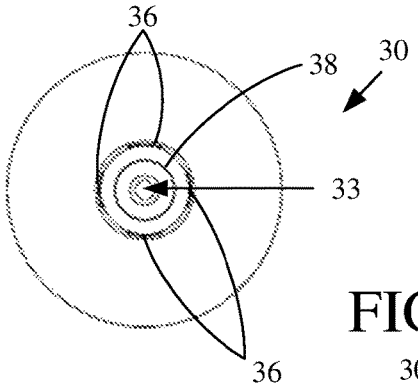
FIG. 3E is a bottom view showing one example valve male housing.
Figure 3B:
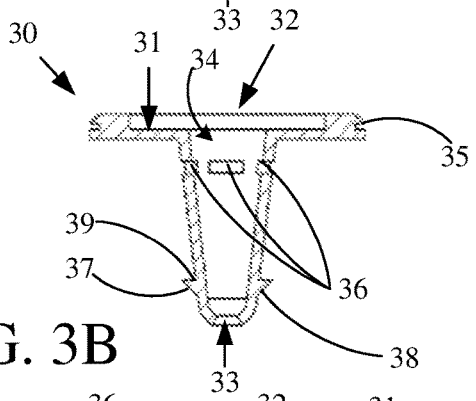
FIG. 3B is a sectional view showing one example valve male housing.
Figure 3A:
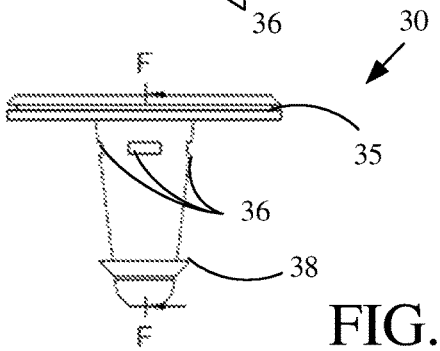
FIG. 3A is a side view showing one example valve male housing.
Figure 3D:
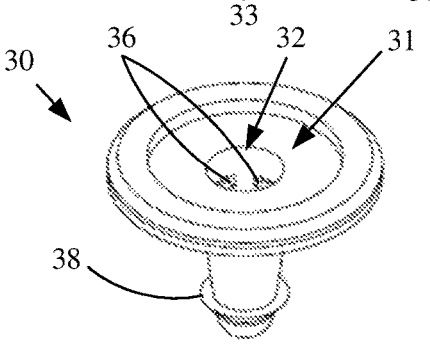
FIG. 3D is a perspective view showing one example valve male housing.
Figure 3F:
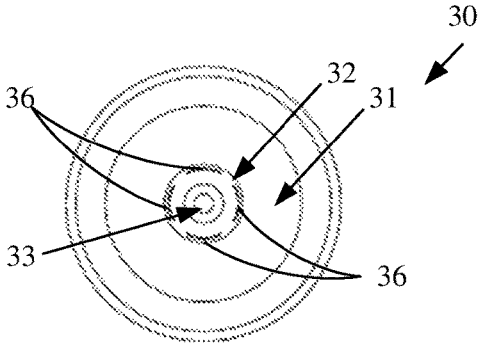
FIG. 3F is a top view showing one example valve male housing.

FIGS. 3A-F show various views of a valve male housing. FIG. 3A is a side view showing valve male housing 30. FIG. 3B is a sectional view showing valve male housing 30 at the line F-F shown in FIG. 3A. FIG. 3C is a perspective view showing valve male housing 30. FIG. 3D is a perspective view showing valve male housing 30. FIG. 3E is a bottom view showing valve male housing 30. FIG. 3F is a top view showing valve male housing 30.

As illustrated in FIG. 3A, valve male housing 30, itself, includes mating feature 35, one or more inlets 36 and locking feature 38. While more than one inlet 36 is shown in, it is to be understood that in other examples, valve male housing 30 may include more inlets or less inlets, such as only a single inlet 36. Inlets 36 provide a fluid pathway, between an interior and exterior of a beverage vessel.

As illustrated in FIG. 3B, valve male housing 30 further includes opening 32, opening 33, cavity 34, and recess 31. As illustrated, valve male housing 30 includes an opening 32 at one end and an opening 33 at an opposite end. Opening 32 and opening 33 provide access to cavity 34. Cavity 34 is configured to receive other items of a valve assembly. As shown in FIG. 3B, valve male housing 30 includes mating feature 35. Mating feature 35 is configured to receive and retain a corresponding mating feature 45 of valve safety cap 40 for coupling valve safety cap 40 to the valve assembly. Valve male housing 30 further includes locking feature 38. Locking feature 38 provides for the coupling and retention of valve male housing 30 within cavity 24 of valve female housing 20. In the illustrated example, locking feature 38 is a tapered protrusion formed in the body (e.g., in the exterior wall) of valve male housing 30. Locking mechanism 38, itself, includes ramp 37 and shoulder 39. As illustrated in FIG. 3B, valve male housing 30 further includes a recess 36. Recess 36 is configured to receive valve head 14 and provide a surface for valve head 14 to bear against to form a fluid-tight seal, such as in a valve closed position. Valve male body 30 can be of variable dimension to accommodate various beverage vessels having various dimensions. In one example, valve male body 30 is a molded body formed of inert and/or FDA approved food grade material(s). In one example, valve male housing 30 is configured to be seated, at least partially, on the exterior (e.g., above a beverage vessel end, such as the beverage vessel cap, lid, top, etc.) of a beverage vessel, such as a beverage can or a beverage bottle.

Figure 4C:
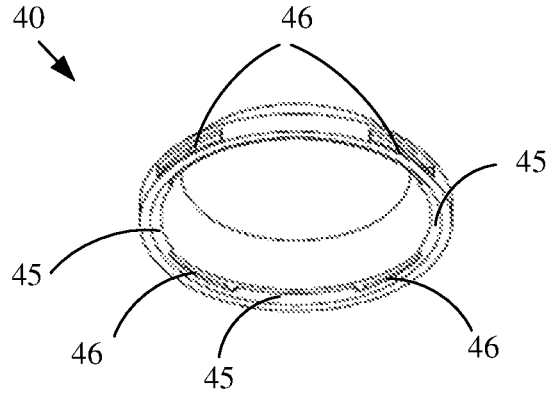
FIG. 4C is a perspective view showing one example valve safety cap.
Figure 4E:
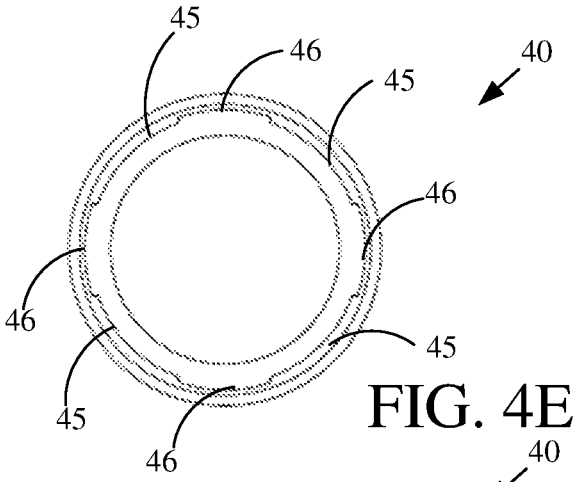
FIG. 4E is a bottom view showing one example valve safety cap.
Figure 4B:
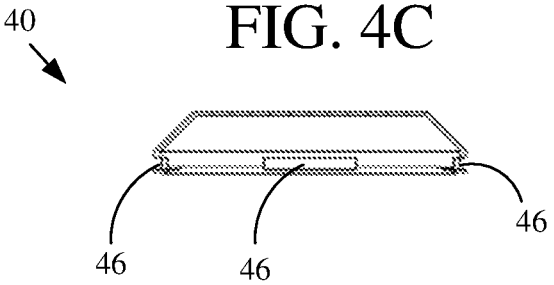
FIG. 4B is a sectional view showing one example valve safety cap.
Figure 4A:
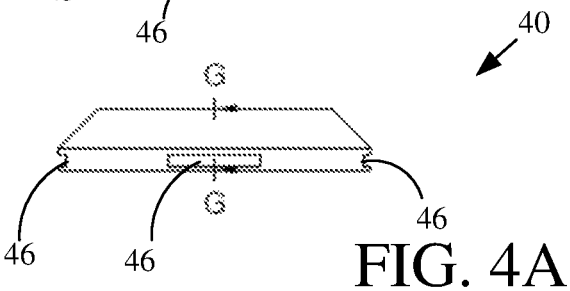
FIG. 4A is a side view showing one example valve safety cap.
Figure 4D:
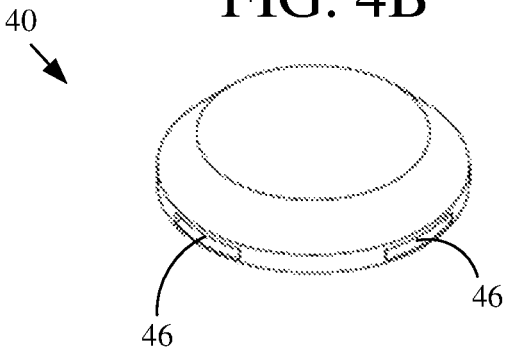
FIG. 4D is a perspective view showing one example valve safety cap.
Figure 4F:
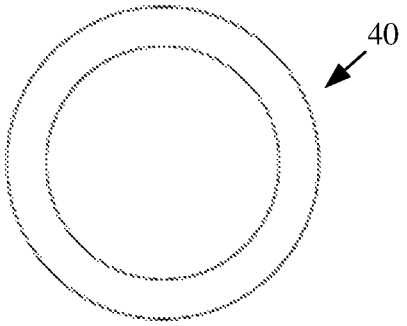
FIG. 4F is a top view showing one example valve safety cap.

FIGS. 4A-F show various views of a valve safety cap. FIG. 4A is a side view showing valve safety cap 40. FIG. 4B is a sectional view showing valve safety cap 40 at the line G-G shown in FIG. 4A. FIG. 4C is a perspective view showing valve safety cap 40. FIG. 4D is a perspective view showing valve safety cap 40. FIG. 4E is a bottom view showing valve safety cap 40. FIG. 4F is a top view showing valve safety cap 40.

As illustrated in FIG. 4A, valve safety cap 40 includes one or more outlets 46. While more than one outlet 46 is shown, it is to be understood that in other examples, valve safety cap 40 may include more outlets or less outlets, such as only a single outlet 46. Outlets 46 provide a pathway for fluid to an exterior of the valve assembly. Valve safety cap 40 can be of variable dimension to accommodate various different beverage vessels having various dimensions. In one example, safety cap 40 is a molded body formed of inert and/or FDA approved food grade material(s). In one example, valve safety cap 40 is configured to be seated on the exterior (e.g., above the cap, lid, top, etc.) of a beverage vessel, such as a beverage can or a beverage bottle.

As illustrated in FIG. 4E, valve safety cap 40 further includes mating features 45. Mating features 45 are, in one example, configured to be received by a corresponding mating feature 35 of valve male housing 30. Mating features 35 and 45 provide coupling between valve safety cap 40 and valve male housing 30. In one example, valve safety cap 40 "snaps-on" to valve male housing 30 such as by placing valve safety cap 40 over valve male housing 30 and applying force on valve safety cap 40 towards valve male housing 30 until mating feature(s) 45 are received in mating feature 35. In one example, valve safety cap 40 is a tamper evident safety cap, for instance, mating features 45 can include weak points or perforations that will result in the breakage or deterioration of the mating feature 45 upon attempting to remove or otherwise tamper with valve safety cap 40, thus disallowing correct re-attachment of the valve safety cap 40 and/or retention of valve safety cap 40.

Figure 7:
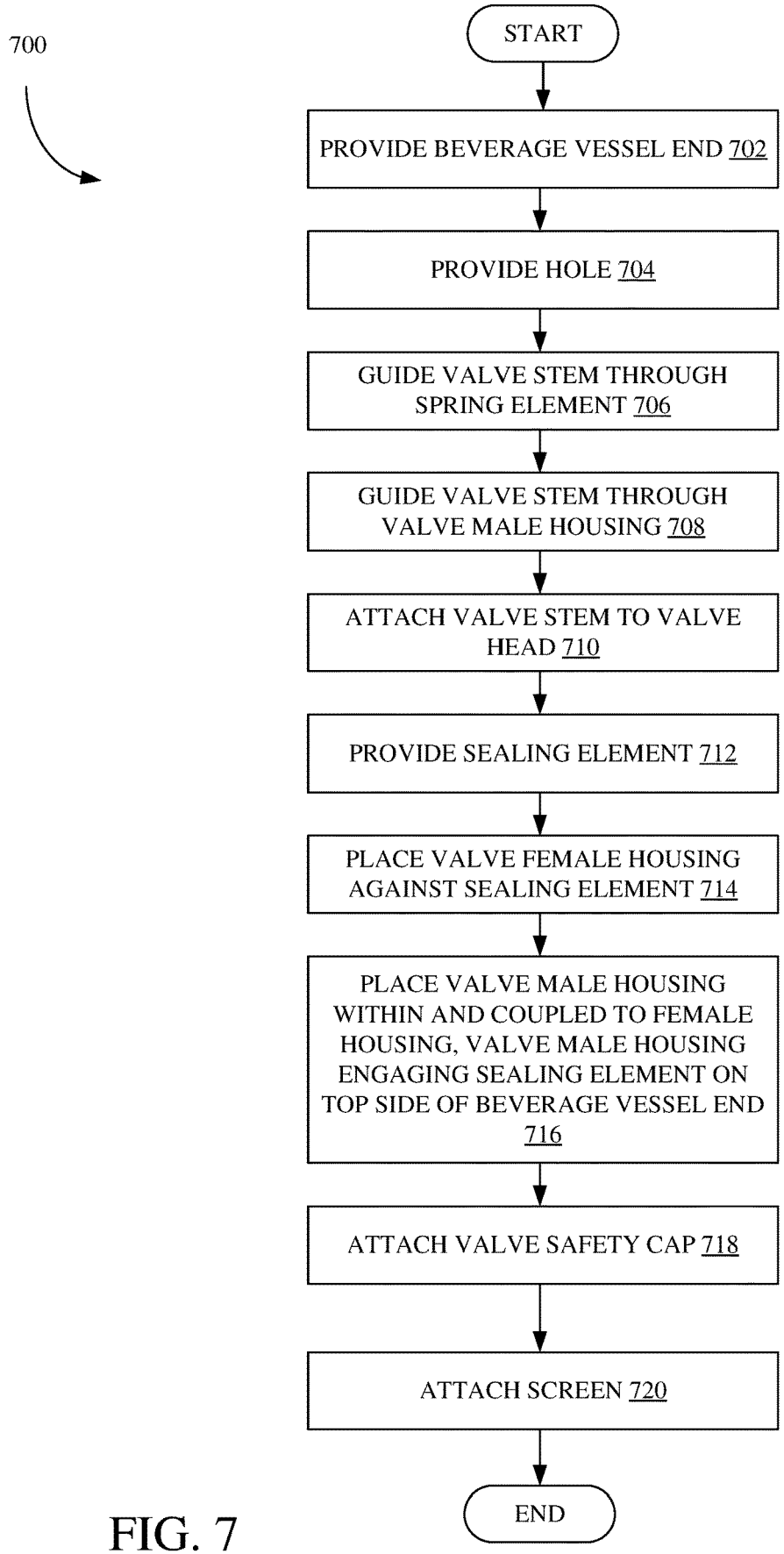
FIG. 7 is a flowchart showing one example method of assembling one example beverage vessel end assembly.

FIG. 7 is a flowchart showing method 700 of assembling a beverage vessel end assembly. Method 700 begins at block 702 where a beverage vessel end (e.g., beverage vessel cap, top, lid, etc.) is provided, such as, but not limited to, lid 82. Method 700 continues at block 704 where the beverage vessel end is provided with a hole configured to receive the pressure relief valve assembly, such as pressure relief valve assembly 50, or at least a portion of the pressure relief valve assembly. In some examples, the beverage vessel end can be manufactured with a hole as integral part of the beverage vessel end. In other examples, the hole can be "punched" into the beverage vessel end, the punched piece can then be recycled or otherwise disposed of. Method 700 continues at block 706 where valve stem 12 is put through spring element 54. Spring element 54 can seat against tapered end 16. Method 700 continues at block 708 where valve stem 12, having spring element 54 disposed thereon, is guided through valve male housing 30, such as first through opening 33 and then through cavity 32, spring element 54 remaining outside of valve male housing and configured to bear against, on one end of the spring, against a surface of valve male housing 30. Method 700 continues at block 710 where valve stem 12 is attached to valve head 14, such as at protrusion 18.

Method 700 continues at block 712 where one or more sealing elements 52 are provided at the hole. The sealing element(s) 52 can be provided at the hole on both the top side of the beverage vessel end and the bottom side of the beverage vessel end. For instance, sealing elements 52 can be two gaskets. In another example, sealing element 52 can be a grommet, including a groove or slot configured to receive a portion of the beverage vessel end, the grommet configured to be disposed at both the top side of the beverage vessel end and the bottom side of the beverage vessel end. Method 700 continues at block 714 where valve female housing 20 is placed against sealing element 52, or portion thereof, disposed on bottom side of beverage vessel end, opening 22 aligned with the hole in the beverage vessel end. Method 700 continues at block 716 where valve male housing 40, including spring element 54 and valve stem and valve head assembly 10, is guided through opening 22 into cavity 24, locking feature 28 and locking feature 38 coupling female housing 20 and male housing 30 together and valve male housing engaging sealing element 52, or portion thereof, disposed on top side of the beverage vessel end. The coupling of female housing 20 and male housing 30 creating a seal by "locking" the male housing within the female housing, creating pressure on the sealing element(s) 52, or portions thereof, on the bottom side of the beverage vessel end and the top side of the beverage vessel end.

Method 700 continues at block 718 where valve safety cap 40 is coupled to valve male housing 30. For example, mating features 45 of valve safety cap 40 are received by mating feature 35 of valve male housing 30. Method 700 continues at block 720 where a screen can be coupled to valve female housing 20, such as on an exterior of valve female housing 20. However, in other examples, the screen can be coupled to or within an interior of valve female housing, and thus will provided along with valve female housing 20 (e.g., at block 714). It should be noted that the screen is optional, and that, in some examples, no screen is provided. The screen may be impermeable to liquid, such as a liquid live beverage within a beverage vessel, but permeable to gas(es), such as gas(es) produced by a live beverage within a beverage vessel. The screen may be placed in front of or behind inlets 26 such that gas(es) may travel through inlets 26 but liquid may not (or is at least inhibited) from traveling through inlets 26.

The beverage vessel end assembly, including the pressure relief valve assembly 50, can then be coupled to a corresponding beverage vessel to seal a beverage therein, such as during a canning or bottling process.

FIGS. 8A-12F illustrate one example embodiment of a pressure actuated pressure relief valve. With reference first to FIGS. 12A-F, FIGS. 12A-F show various views of a beverage end assembly 180 including a pressure relief valve assembly 140. FIG. 12A is a perspective view showing beverage vessel end assembly 180. FIG. 12B is an enlarged view showing portion 185 of beverage vessel end assembly 180. FIG. 12C is a perspective view showing beverage vessel end assembly 180. FIG. 12D is an enlarged view showing portion 189 of beverage vessel end assembly 180. FIG. 12E is bottom view showing beverage vessel lid assembly 180. FIG. 12F is a top view showing beverage vessel lid assembly 180.

Beverage vessel end assembly 180, itself, includes lid 182, tab 184, mouth 186, and pressure relieve valve assembly 140. Those skilled in the art will appreciate that FIG. 12A illustrates the top side of lid 182. Lid 182, itself, includes rim 183, tab 184, and mouth 186. As illustrated pressure relieve valve assembly 140 is installed into lid 182 at a position between tab 184 and/or mouth 186 and rim 183. As can also be seen, in one example, pressure relieve valve assembly 140 has a height less than the height of rim 183. While the dimensionality and placement of pressure relieve valve assembly 140 can be varied, in one example, pressure relief valve assembly 140 is configured such that it does not restrict or otherwise interfere with the stacking of beverage vessels, such as beverage cans. That is, valve assembly 140 is placed far enough away from rim 183 and has a low enough height such that another beverage vessel can be stacked on top of the beverage vessel including lid 182.

In some examples, valve housing 120 is of a dimension (e.g., length) such that when the beverage vessel is in an upright position, valve housing 120 is not submerged in the beverage contained in the beverage vessel, due both to the dimension of valve housing 120 and a space between a top surface of the volume of beverage in the beverage vessel and the bottom side of lid 182. In other examples, valve housing 120 may be partially or fully submerged in the beverage contained in the beverage vessel.

Those skilled in the art will appreciate that FIG. 12C illustrates the bottom side of lid 182. FIG. 12C illustrates beverage vessel end assembly 180 having pressure relief valve assembly 140 removed, thus exposing hole 187. Hole 187 is configured to receive pressure relief valve assembly 140. In some examples, lid 182 can be manufactured with hole 187, thus reducing the amount of material necessary for the manufacture of lid 182. In other examples, lid 182 can be manufactured in traditional fashion (e.g., as a solid piece, a standard lid, etc.) and then hole 187 can be punched through lid 182, allowing the recycling (or disposal) of the punched piece of lid 182.

With reference next to FIGS. 11A-F, FIGS. 11A-F show various views of a pressure relief valve assembly 140. FIG. 11A is a side view showing pressure relief valve assembly 140. FIG. 11B is a sectional view showing pressure relief valve assembly 140 at line C-C shown in FIG. 11A. FIG. 11C is a perspective view showing pressure relief valve assembly 140. FIG. 11D is a perspective view showing pressure relief valve assembly 140. FIG. 11E is a bottom view showing pressure relief valve assembly 140. FIG. 11F is a top view showing pressure relief valve assembly.

In addition to valve head 110, valve housing 120, and valve safety cover 130, pressure relief valve assembly 140 includes spring element 142 and sealing element 144. Spring element 142, as illustrated, comprises a coil spring, though, in other examples, can be various other suitable spring elements, such as leaf spring(s). Spring element 142, is received and retained by protrusion 114 of valve head 110 and protrusion 134 of valve safety cap 130. Spring element 142 can be of variable resistance and variable dimension for suitability with a variety of applications. In one example, spring element 142 is formed of inert and/or FDA approved food grade material(s).

Sealing element 144 provides a fluid-tight seal between an interior and an exterior of the beverage vessel in which pressure relief valve assembly 140 is installed. Sealing element 142 can include any number of suitable sealing elements, such as a one or more gaskets, one or more sealing washers, one or more grommets, one or more O-rings, as well any of a number of other suitable sealing elements. In one example, sealing element 144 is formed of inert and/or FDA approved food grade material(s). Sealing element 144 can be of variable dimension to accommodate various different beverage vessels. In some examples, multiple sealing elements 144 are used in valve assembly 140, for example, one sealing element 144 on the top side (e.g., configured to contact the top side) of the beverage vessel end (e.g., lid, top, cap, etc.) and another sealing element 144 on the bottom side (e.g., configured to contact the bottom side) of the beverage vessel end.

When pressure relief valve assembly 140 is assembled, as shown in FIG. 11B, spring 142 bears against a surface (e.g., top side) of valve head 110 and a surface (e.g., bottom side) of valve safety cover 130. Spring 142 has a set resistance that naturally biases valve head to a valve closed position (as shown in FIG. 11B), in the direction indicated by arrow 150, wherein valve head 110 is seated against valve housing 120 and provides a seal, thus preventing the flow of fluid to an exterior of pressure relief valve assembly 140. While contained in a beverage vessel, a live beverage ferments and releases a volume of gas(es) as a natural byproduct. The gas(es) can be exposed to interior of pressure relief valve assembly 140 via inlet 125, whereby the pressure of the gas volume can bear against items of pressure relief valve gas assembly 140. As more gas is produced the pressure of the volume of gas(es) will increase until its force overcomes the resistance force of spring element 142, causing spring element 142 to compress, or otherwise actuate, and causing a valve driving movement which drives valve head 110 in the direction indicated by arrow 160 to a valve open position in which valve head 110 is unseated from valve housing 120. In the valve open position, fluid (e.g., gas(es) produced by live beverage) can escape to an exterior of pressure relief valve assembly 50 through outlets 132, thereby relieving (e.g., reducing) the interior pressure within the beverage vessel. Once the pressure has reduced sufficiently, the resistance force of the spring will overcome the force of the interior pressure of the volume of gas(es) and thereby drive valve head 110 to a valve closed position, preventing further flow of fluid to the exterior of pressure relief valve assembly 140.

Figure 8C:
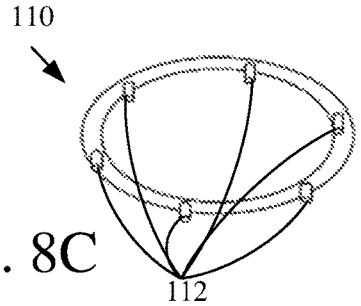
FIG. 8C is a perspective view showing one example valve head.
Figure 8E:
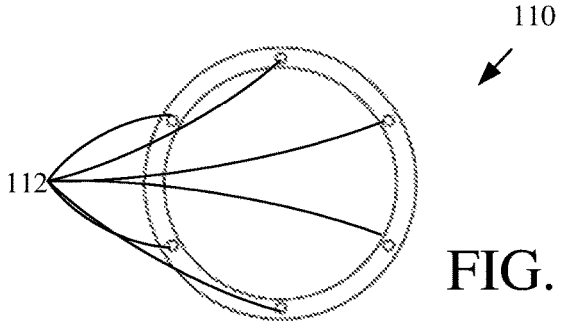
FIG. 8E is a bottom view showing one example valve head.
Figure 8B:
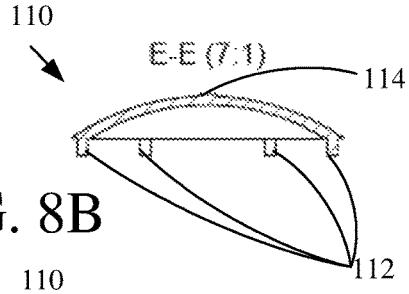
FIG. 8B is a sectional view showing one example valve head.
Figure 8A:
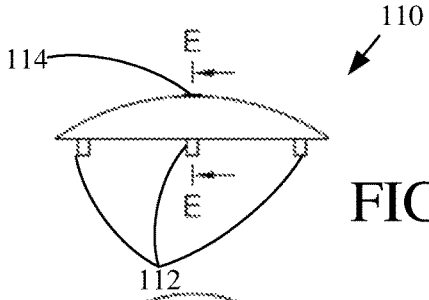
FIG. 8A is a side view showing one example valve head.
Figure 8D:
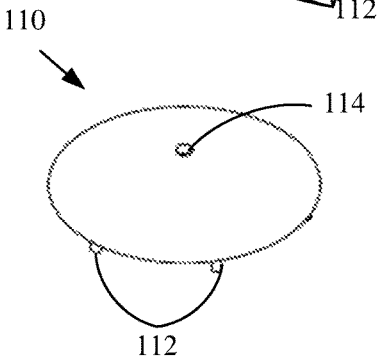
FIG. 8D is a perspective view showing one example valve head.
Figure 8F:
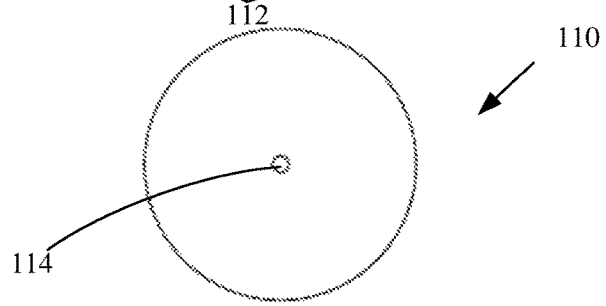
FIG. 8F is a top view showing one example valve head.

FIGS. 8A-F show various views of a valve head. FIG. 8A is a side view showing valve head 110. FIG. 8B is sectional view showing valve head 110 at line E-E shown in FIG. 8A. FIG. 8C is a perspective showing valve head 110. FIG. 8D is a perspective view showing valve head 110. FIG. 8E is bottom view showing valve head 110. FIG. 8F is a top view showing valve head 110.

Valve head 110, itself, includes one or more guiding pins 112 and a protrusion 114. Guiding pins 112 are configured to be received by corresponding portions of a valve assembly. While more than one guiding pin 112 is shown, it is to be understood that in other examples, valve head 110 may include more guiding pins or less guiding pins, such as only a single guiding pin 112. Protrusion 114 is shown disposed at the top side of valve head 110 and is configured to receive and retain a spring, such as spring 142. In one example, valve head 110 is a molded body formed of inert and/or FDA approved food grade material(s). Valve head 110 can be of variable dimension to accommodate various different beverage vessels.

Figure 9C:
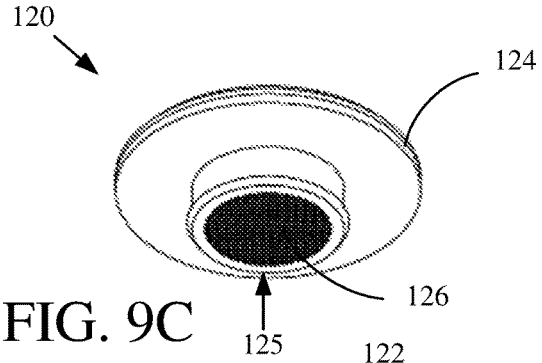
FIG. 9C is a perspective view showing one example valve housing.
Figure 9E:
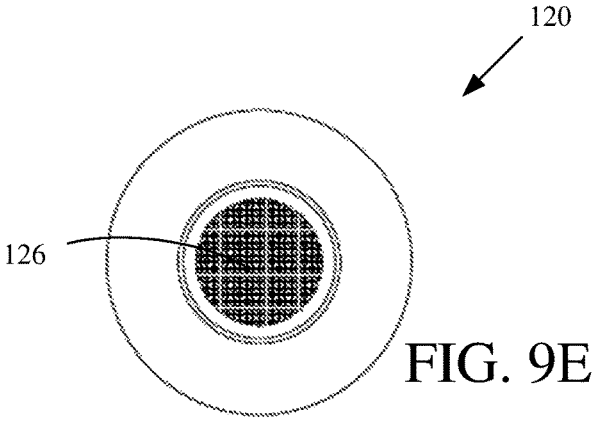
FIG. 9E is a bottom view showing one example valve housing.
Figure 9B:
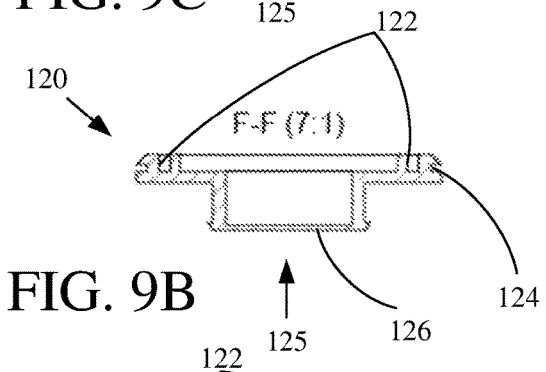
FIG. 9B is a sectional view showing one example valve housing.
Figure 9A:
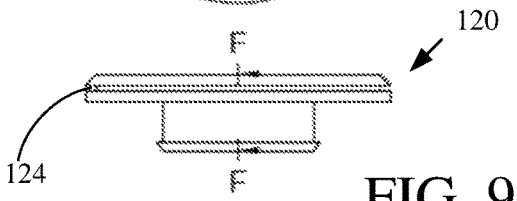
FIG. 9A is a side view showing one example valve housing.
Figure 9D:
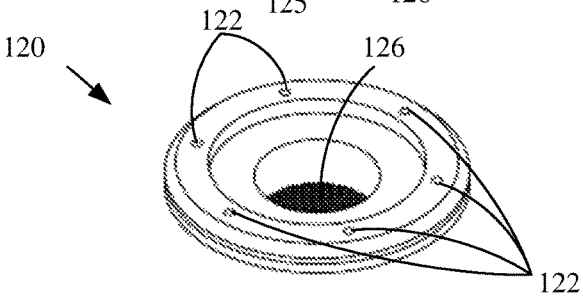
FIG. 9D is a perspective view showing one example valve housing.
Figure 9F:
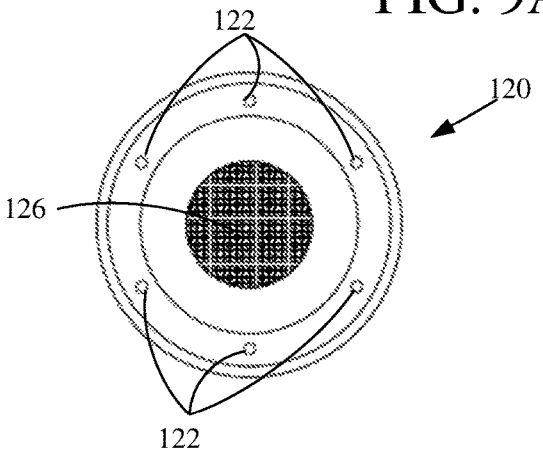
FIG. 9F is a top view showing one example valve housing.
Figure 10E:
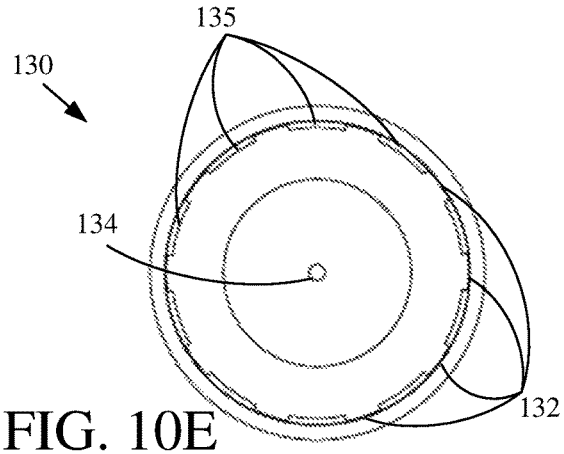
FIG. 10E is a bottom view showing one example valve safety cap.
Figure 10C:
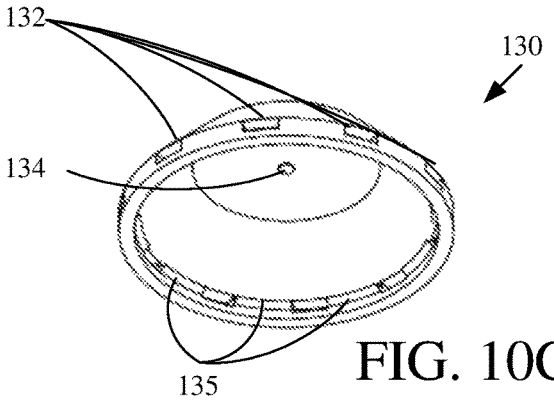
FIG. 10C is a perspective view showing one example valve safety cap.
Figure 10A:
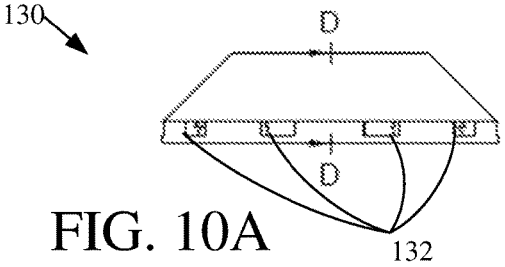
FIG. 10A is a side view showing one example valve safety cap.
Figure 10B:
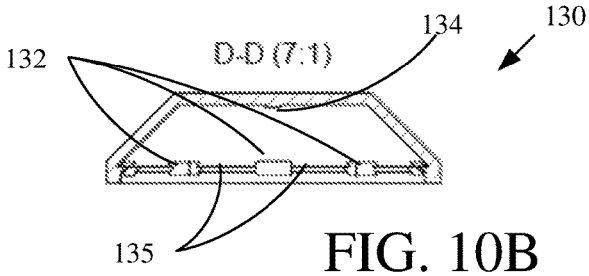
FIG. 10B is a sectional view showing one example valve safety cap.
Figure 10F:
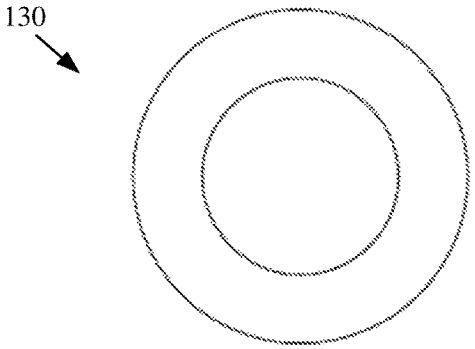
FIG. 10F is a top view showing one example valve safety cap.
Figure 10D:
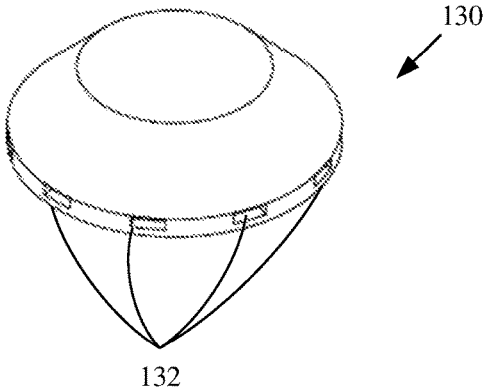
FIG. 10D is a perspective view showing one example valve safety cap.

FIGS. 9A-F show various views of a valve housing. FIG. 9A is a side view showing valve housing 120. FIG. 9B is a sectional view showing valve housing 120 at line F-F shown in FIG. 9A. FIG. 9C is a perspective showing valve housing 120. FIG. 9D is a perspective showing valve housing 120. FIG. 9E is a bottom view showing valve housing 120. FIG. 9F is a top view showing valve housing 120.

Valve housing 120, itself, includes one or more recesses 122, mating feature 124, inlet 125, and a screen 126. Recesses 122 are configured to receive corresponding portions of a valve assembly, such as guiding pins 112. While more than one recess 122 is shown, it is to be understood that in other examples, valve housing 120 may include more recesses or less recesses, such as only a single recess 122. In some examples, the number of recesses 122 corresponds to the number of guiding pins 112 of valve head 110. Mating feature 124 is configured to receive a corresponding mating feature of the valve assembly, such as mating feature(s) 135. Inlet 125 is configured to provide access to an interior of valve housing 120. Screen 126 is placed at inlet 125. Screen 126 is, in one example, impermeable to liquid, such as the live liquid beverage contained in a beverage vessel but is permeable to gas(es), such as gas(es) produced by the live liquid beverage contained in the beverage vessel. Screen 126 thereby prevents liquid from accessing an interior of valve housing 120 but allows gas, such as gas(es) produced by a live beverage, to access an interior of valve housing 120. Screen 126, being impermeable to liquid, can arrest the development of debris buildup, within a valve assembly, by debris which may be carried by a liquid beverage. Such debris buildup can, in some examples, affect the normal functioning of a valve assembly. In one example, valve housing 120 is a molded body formed of inert and/or FDA approved food grade material(s). Valve housing 120 can be of variable dimension to accommodate various different beverage vessels.

FIGS. 10-F show various views of a valve safety cap. FIG. 10A is a side view showing valve safety cap 130. FIG. 10B is a sectional view showing valve safety cap 130 at line D-D shown in FIG. 10A. FIG. 10C is a perspective view showing valve safety cap 130. FIG. 10D is a perspective view showing valve safety cap 130. FIG. 10E is a bottom view showing valve safety cap 130. FIG. 10F is a top view showing valve safety cap 130.

Valve safety cap 130, itself, includes one or more outlets 132, a protrusion 134, and one or more mating features 135. Outlets 132 are configured to provide a fluid pathway, such as a pathway for fluid to an exterior of a valve assembly. While more than one outlet 132 is shown, it is to be understood that in other examples, valve safety cap 130 may include more outlets or less outlets, such as only a single outlet 132. Protrusion 134 is configured to receive and retain a spring element, such as spring 142.

Mating features 135 are configured to be received by a corresponding portion of a valve assembly, such as mating feature 124 of valve housing 120. While more than one mating feature 135 is shown, it is to be understood that in other examples, valve safety cap 130 may include more mating features or less mating features, such as only a single mating feature 135. In one example, mating features 124 and 135 provide coupling between valve housing 120 and valve safety cap 130. In one example, valve safety cap 130 "snaps-on" to valve housing 120 such as by placing valve safety cap 130 over valve housing 120 and applying force on valve safety cap 130 towards valve housing 120 until mating feature(s) 135 are received in mating feature 124. In one example, valve safety cap 130 is a tamper evident safety cap, for instance, mating features 135, in some examples, include weak points or perforations that will result in the breakage or deterioration of the mating feature 135 upon attempting to remove or otherwise tamper with valve safety cap 130, thus disallowing correct re-attachment of the valve safety cap 130 and/or retention of valve safety cap 130. In one example, valve safety cap 130 is a molded body formed of inert and/or FDA approved food grade material(s). Valve safety cap 130 can be of variable dimension to accommodate various different beverage vessels.

Figure 13:
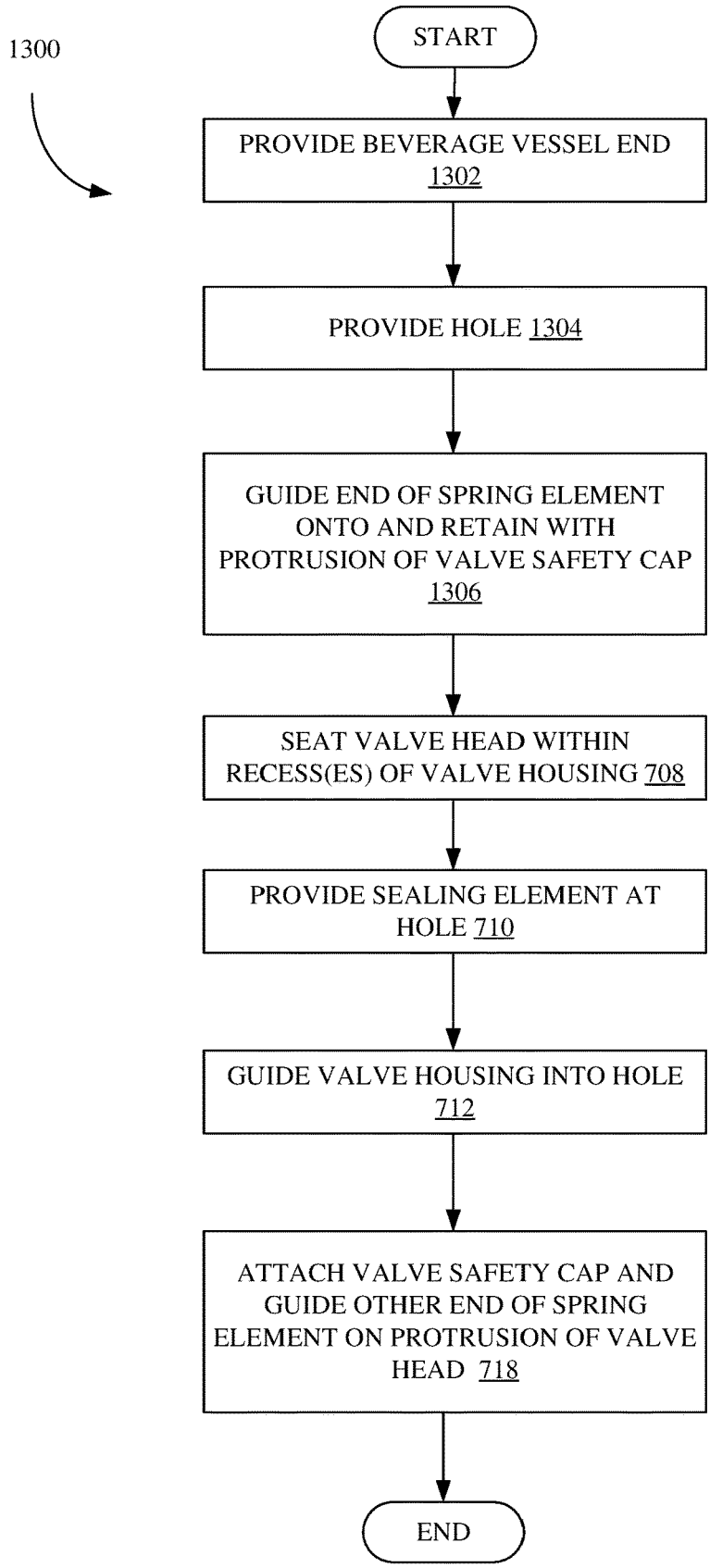
FIG. 13 is a flowchart showing one example method of assembly one example beverage vessel end assembly.

FIG. 13 is a flowchart showing method 1300 of assembling a beverage vessel lid assembly. Method 1300 begins at block 1302 where a beverage vessel end (e.g., beverage vessel cap, top, lid, etc.) is provided, such as, but not limited to, lid 182. In some examples, the beverage vessel end, provided at block 1302, is already integrated (e.g., coupled to) a beverage vessel, and thus, in such examples, method 1300 only requires access to a top side of the beverage vessel end. Method 1300 continues at block 1304 where the beverage vessel end is provided with a hole, such as hole 187, configured to receive the pressure relief valve assembly, or at least a portion of the pressure relief valve assembly. In some examples, the beverage vessel end can be manufactured with a hole as integral part of the beverage vessel end. In other examples, the hole can be "punched" into the beverage vessel end, the punched piece can then be recycled or otherwise disposed of.

Method 1300 continues at block 1306 where spring element 142 is, at one end of spring element 142, guided on to and retained by protrusion 134 of valve safety cap 130.

Method 1300 continues at block 1308 where valve head 110 is seated within valve housing 120, by placing guiding pins 112 of valve head 110 into recesses 122 of valve housing 120. Method 1300 continues at block 1310 where a sealing element is provided at the hole in the beverage vessel end. In one example, a sealing element, such as a gasket, sealing washer, O-ring is placed on the top side of beverage vessel end. In some examples, a sealing element, such as a grommet, is disposed both on the top side and bottom side of the beverage vessel end. Method 1300 continues at block 1312 where valve housing 120, including valve head 110 seated therein, is guided into, such as by pressing into the hole in the beverage vessel end, where the valve housing 120 is retained and engages the sealing element disposed at the hole in beverage vessel end. Method 1300 continues at block 1300 continues at block 1314 where valve safety cap 130, including spring element 142, is coupled to valve housing 120. In one example, coupling valve safety cap 130 to valve housing 120 includes receiving mating features 135 of valve safety cap in mating feature 125 of valve housing. Additionally, at block 1300 an end of spring element 142, opposite the end coupled to protrusion 134 of valve safety cap, is guided onto and retained by protrusion 114 of valve head 110.

In examples in which the beverage vessel end is not already integrated with a beverage vessel, the beverage vessel assembly, including pressure relief valve assembly 140, can be coupled to a corresponding beverage vessel to seal a beverage therein, such as during a canning or bottling process.

FIGS. 14A-17F illustrate one example embodiment of a pressure actuated pressure relief valve. With reference first to FIGS. 17A-F, FIGS. 17A-F show various views of a pressure relief valve assembly 240. FIG. 17A is a side view showing pressure relief valve assembly 240. FIG. 17B is a sectional view showing pressure relief valve assembly 240 at line A-A shown in FIG. 17A. FIG. 17C is a perspective view showing pressure relief valve assembly 240. FIG. 17D is a perspective view showing pressure relief valve assembly 240. FIG. 17E is a side view showing pressure relief valve assembly 240. FIG. 17F is a top view showing pressure relief valve assembly 240.

As illustrated in FIG. 17A, pressure relief valve assembly 240 includes spring clip 210, sealing head 220, and sealing element 230. It will be appreciated, that when assembled, sealing head 220, or portions thereof, such as locking features 222, is inserted through aperture 232 of sealing element 230 and aperture 212 of spring clip 210. Sealing element 230 is configured to be seated on the top side of a beverage vessel end (e.g., lid, top, cap, etc.) while spring clip 210 is disposed on the bottom side of the beverage vessel end. Standoffs 216 contact (or bear against, such as when a sealing element is disposed between standoffs 216 and the bottom side of beverage vessel end) the bottom side of the beverage vessel end while sealing element 230 is compressed, by virtue of the coupling of sealing valve head 220 to spring clip 210 (e.g., spring clip 210 naturally biases valve head 220 towards interior of beverage vessel wherein valve head 320 compresses sealing element 230), to form a fluid-tight seal between an exterior and interior of a beverage vessel in which pressure relief valve assembly 240 is incorporated. When the force (e.g., pressure) of a volume of gas(es) produced by a live beverage within the beverage vessel sufficiently overcomes the natural resistance of spring clip 210 and compresses standoffs 216, assembly 240 moves in the direction indicated by arrow 250 (e.g., valve head 220 moves away from the beverage vessel end) to a valve open position wherein the compression on sealing element 230 is relieved, thereby providing a gap, as an outlet, for the volume of gas(es) to escape to an exterior of the beverage vessel. When the internal pressure is sufficiently relieved, assembly 240 (or portions thereof) moves in the direction indicated by arrow 260 to a valve closed position wherein the gap is closed, and the seal is reestablished thus preventing the flow of fluids to the exterior of the beverage vessel.

As will be appreciated, when valve assembly 240 is assembled, there remains a gap between locking features 222, such gap providing a pathway (e.g., inlet) for fluids to travel through.

FIGS. 14A-E show various views of a spring clip. FIG. 14A is a side view showing spring clip 210. FIG. 14B is a side view showing spring clip 210. FIG. 14C is a perspective view showing spring clip 210. FIG. 14D is a perspective view showing spring clip 210. FIG. 14E is a top view showing spring clip 210.

Spring clip 210, itself, includes aperture 212, surface 214, and standoffs 216. Aperture 212 is configured to receive corresponding portions of a valve assembly, such as locking features 222 of sealing head 220. Surface 214 is configured to provide a surface against which corresponding portions of a valve assembly bear against, such as shoulders 224 of locking features 222. Standoffs 216 are configured to contact the bottom side of a beverage vessel end (e.g., lid, top, cap, etc.), creating or providing a gap between a portion of spring clip 210 and the bottom side of the beverage vessel end. In some examples, standoffs 216 are configured to contact a sealing element which is in contact with the bottom side of the beverage vessel and disposed between the standoffs 216 and the bottom side of the beverage vessel end. Spring clip 210 is a spring element in that it biases at least a portion of a valve assembly in a direction, such as towards an interior of a beverage vessel in which the valve assembly is incorporated, to a valve closed position. Spring clip 210 is of a dimension and made of a material having a select resistance. However, spring clip 210 is compressible, such that, in response to force (such as the force of pressure of a volume of gas(es) in a beverage vessel) bearing against spring clip 210, spring clip 210 will compress, such as compressing standoffs 216 (which bear against the beverage vessel), reducing the gap between the beverage vessel end and the spring clip 210, and drive movement of the valve assembly to a valve open position.

While more than one standoff 216 is shown, it is to be understood that in other examples, spring clip 210 may include more standoffs or less standoffs, such as only a single standoff 216. In one example, spring clip 210 is a molded body formed of inert and/or FDA approved food grade material(s). Spring clip 210 can be of variable dimension to accommodate various different beverage vessels.

FIGS. 15A-E show various views of a valve sealing head. FIG. 15A is a perspective view showing sealing valve head 220. FIG. 15B is a perspective view showing sealing valve head 220. FIG. 15C is a perspective view showing sealing valve head 220. FIG. 15D is a perspective showing sealing valve head 220. FIG. 15E is a top view showing sealing valve head 220.

Sealing valve head 220, itself, includes one or more locking features 222. While more than one locking feature 222 is shown, it is to be understood that sealing valve head 220 can include more locking features or less locking features, for instance, a single locking feature 222. Each locking feature 222, itself, includes a shoulder 224 and a ramp 225. Locking features 222 are configured to be inserted through aperture 212 of spring clip 210. When inserted, shoulders 224 are configured to bear against surface 214 of spring clip 210 to securely couple spring clip 210 and sealing valve head 220. In one example, sealing valve head 220 is a molded body formed of inert and/or FDA approved food grade material(s). Sealing valve head 220 can be of variable dimension to accommodate various different beverage vessels.

As shown in FIG. 15C, sealing valve head 220 further includes recess 227. In one example, recess 227 is configured to receive at least a portion of a sealing element, such as sealing element 230, discussed below. Recess 227, by receiving sealing element 230, prevents blowout of sealing element 230, that is, it securely retains sealing element within the valve assembly. Additionally, recess 227 is a tamper feature in that it and serves to prevent or inhibit tampering with the seal and/or sealing element. Additionally, pressure relief valve assembly 240 can, in some examples, act as a tamper-evident device in that the pressure relief valve assembly will weaken when subjected to unequal pressure from outside forces (e.g., prying on portions of the assembly 240 on the top side of the beverage vessel end, such as the valve head 220) such that it will appear different and/or will not be able to maintain a proper seal.

Figure 16A:
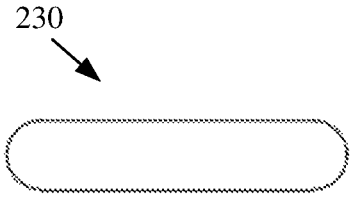
FIG. 16A is a side view showing one example sealing element.
Figure 16B:
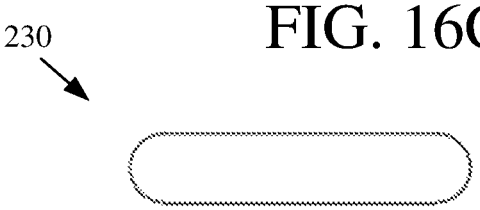
FIG. 16B is a side view showing one example sealing element.
Figure 16C:
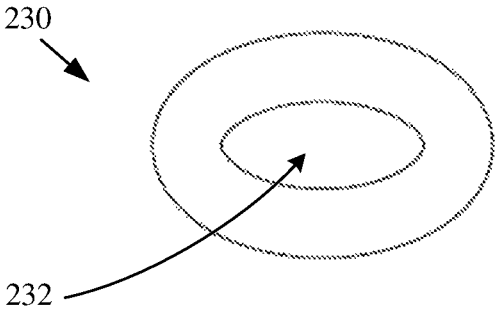
FIG. 16C is a perspective view showing one example sealing element.
Figure 16E:
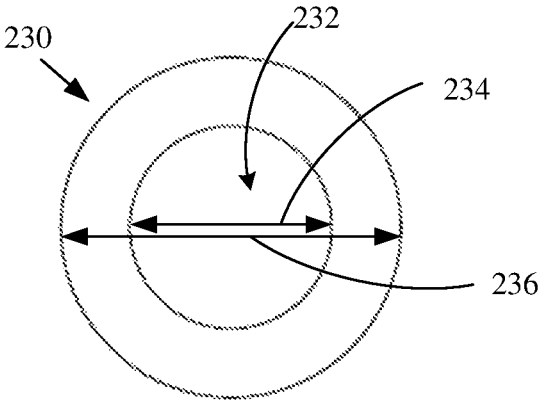
FIG. 16E is a top or bottom view showing one example sealing element.
Figure 16D:
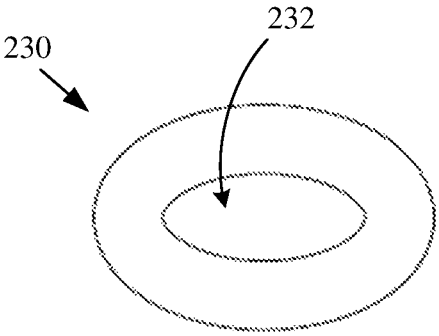
FIG. 16D is a perspective view showing one example sealing element.

FIGS. 16A-E show various views of a sealing element. FIG. 16A is a side view showing sealing element 230. FIG. 16B is a side view showing sealing element 230. FIG. 16C is a perspective view showing sealing element 230. FIG. 16D is a perspective view showing sealing element 230. FIG. 16E is a top or bottom view showing sealing element 230.

Sealing element 230, itself, includes aperture 232, internal diameter 234, and external diameter 236. Aperture 232 is configured to receive therethrough other portions of a valve assembly, such as locking features 222 of sealing valve head 220 as well as provide a pathway (e.g., inlet) for fluids to travel through. Sealing element 230 can be of variable dimensions, for example, both the internal diameter 234 and the external diameter 236 can be varied for suitability with various implementations. In one example, sealing element 230 has an internal diameter 234 of 7 millimeters (mm) and an external diameter 236 of 9 mm. Various other dimensions are contemplated herein. Sealing element 230 is configured to sit directly on the beverage vessel lid, top, cap, etc. and within recess 227 of sealing head 220. Sealing element 230 provides a fluid-tight seal between an interior and exterior of a beverage vessel. Sealing element 230 is, in one example, an O-ring, however, various other sealing elements are contemplated herein, for example, one or more gaskets, one or more sealing washers, one or more grommets, as well as various other suitable sealing elements. In some examples, multiple sealing elements 230 are used in a valve assembly 240, for example, one sealing element 230 on the top side (e.g., configured to contact the top side) of the beverage vessel end (e.g., lid, top, cap, etc.) and another sealing element 230 on the bottom side (e.g., configured to contact the bottom side) of the beverage vessel end.

In one example, sealing element 230 is formed of inert and/or FDA approved food grade material(s). Sealing element 230 can be of variable dimension to accommodate various different beverage vessels.

Figure 21E:
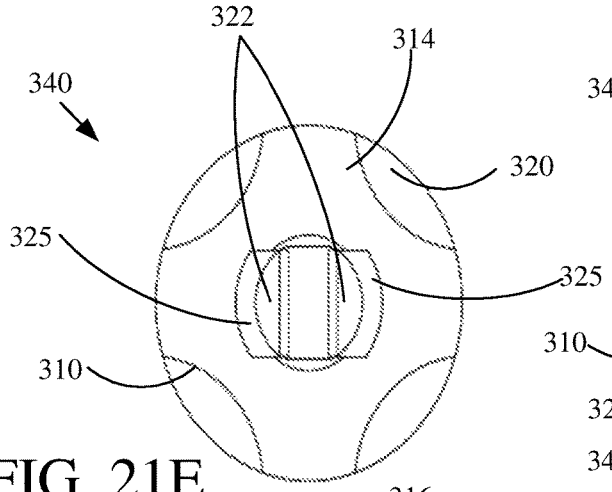
FIG. 21E is a bottom view showing one example pressure relief valve assembly.
Figure 21A:
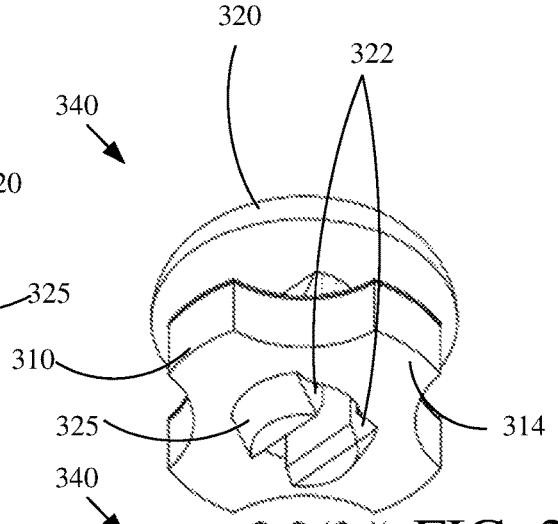
FIG. 21A is a side view showing one example pressure relief valve assembly.
Figure 21A:
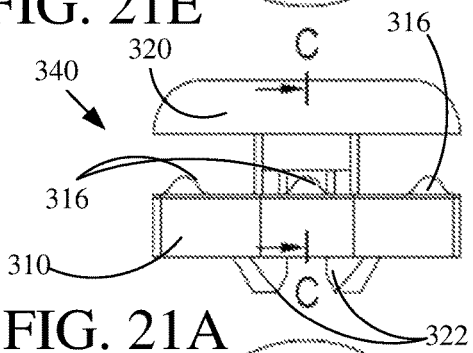
Figure 21B:
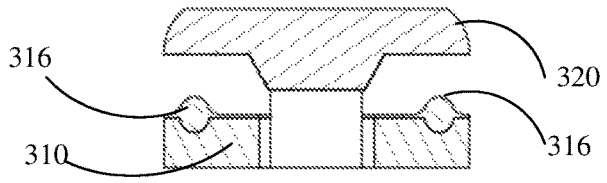
FIG. 21B is a sectional view showing one example pressure relief valve assembly.
Figure 21F:
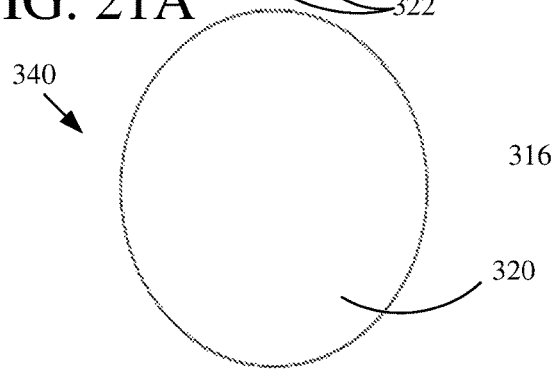
FIG. 21F is a top view showing one example pressure relief valve assembly.
Figure 21D:
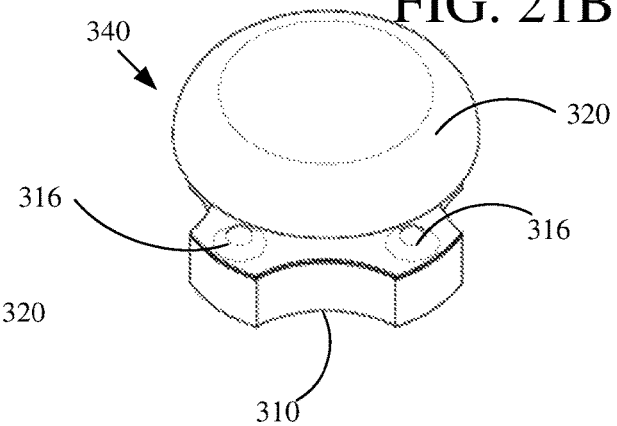
FIG. 21D is a perspective view showing one example pressure relief valve assembly.

FIGS. 18A-21F illustrate one example embodiment of a pressure actuated pressure relief valve. With reference first to FIGS. 21A-F, FIGS. 21A-F show various views of a pressure relief valve assembly 340. FIG. 21A is a side view showing pressure relief valve assembly 340. FIG. 21B is a sectional view showing pressure relief valve assembly 340 at line C-C shown in FIG. 21A. FIG. 21C is a perspective view showing pressure relief valve assembly 340. FIG. 21D is a perspective view showing pressure relief valve assembly 340. FIG. 21E is a bottom view showing pressure relief valve assembly 340. FIG. 21F is a top view showing pressure relief valve assembly 340.

Pressure relief valve assembly 340 includes spring clip 310 and sealing head 320. Though not depicted in the FIGS., it will be appreciated that pressure relief valve assembly 340 further includes sealing element 330. In one example, sealing element 330 is disposed between spring clip 310 and sealing valve head 320, with locking features 322 of sealing valve head 320 disposed through aperture 332 of sealing element 330. It will be appreciated, that when assembled, sealing valve head 320, or portions thereof, such as locking features 322, is inserted through aperture 332 of sealing element 330 and aperture 312 of spring clip 310. Sealing element 330 is configured to be seated on the top of a beverage vessel end (e.g., lid, top, cap, etc.) while spring clip 310 is disposed on the bottom side of the beverage vessel end. Standoffs 316 contact (or bear against, such as when a sealing element is disposed between standoffs 316 and the bottom side of beverage vessel end) the bottom side of the beverage vessel end while sealing element 330 is compressed, by virtue of the coupling sealing valve head 320 to spring clip 310 (e.g., spring clip 310 naturally biases valve head 320 towards interior of beverage vessel wherein valve head 320 compresses sealing element 330), to form a fluid-tight seal between an exterior and an interior of the beverage vessel in which pressure relief valve assembly 340 is incorporated. When the force (e.g., pressure) of a volume of gas(es) produced by a live beverage within the beverage vessel sufficiently overcomes the natural resistance of spring clip 310 and compresses standoffs 316, assembly 340 (or a portion thereof) moves in the direction indicated by arrow 350 (e.g., head 220 moves away from the beverage vessel end) to a valve open position wherein the compression on sealing element 330 is relieved creating a gap, as an outlet, for the volume of gas(es) to escape to an exterior of the beverage vessel. When the internal pressure is sufficiently relieved, assembly 340 (or a portion thereof) moves in the direction indicated by arrow 360 to a valve closed position wherein the gap is closed, and the seal is reestablished thus preventing the flow of fluids to the exterior of the beverage vessel.

As will be appreciated, when valve assembly 340 is assembled, there remains a gap between locking features 322, such gap providing a pathway (e.g., inlet) for fluids to travel through.

FIGS. 18A-D show various views of a spring clip. FIG. 18A is a side view showing spring clip 310. FIG. 18B is a perspective view showing spring clip 310. FIG. 18C is a perspective view showing spring clip 310. FIG. 18D is a bottom view showing spring clip 310.

Spring clip 310, itself, includes aperture 312 and one or more standoffs 316. Aperture 312 is configured to receive corresponding portions of a valve assembly, such as locking features 322 of sealing head 320. Additionally, aperture 312 provides a pathway (e.g., an inlet) through which fluids can travel, such as a volume of gas(es) produced by a live beverage within a beverage vessel. Standoffs 316 are configured to contact the bottom side of a beverage vessel end (e.g., lid, top, cap, etc.), creating a gap between the remainder of spring clip 310 and the bottom side of the beverage vessel end. In some examples, standoffs 316 are configured to contact a sealing element which is in contact with the bottom side of the beverage vessel and disposed between the standoffs 316 and the bottom side of the beverage vessel end. Spring clip 310 is a spring element in that it biases at least a portion of a valve assembly in a direction, such as towards an interior of a beverage vessel in which the valve assembly is incorporated to a valve closed position. Spring clip 310 is of a dimension and made of a material having a select resistance. However, spring clip 310 is compressible, such that, in response to force (such as the force of pressure of a volume of gas(es) in a beverage vessel) bearing against spring clip 310, spring clip 310 will compress, for instance, standoffs 316 (which bear against the beverage vessel) will compress, reducing the gap between the beverage vessel end and the spring clip 310, and drive movement of the valve assembly to a valve open position wherein fluid, such as the volume of gas(es), can escape to an exterior of the beverage vessel.

While more than one standoff 316 is shown, it is to be understood that spring clip 310 can include more standoffs or less standoffs, for instance, a single standoff 316. In one example, spring clip 310 is a molded body formed of inert and/or FDA approved food grade material(s). Spring clip 310 can be of variable dimension to accommodate various different beverage vessels.

As illustrated in FIG. 18B, spring clip 310 further includes surface 314. Surface 314 is configured to provide a surface against which corresponding portions of a valve assembly bear against, such as a shoulder 324 of a locking feature 322 of valve head 320.

FIGS. 19A-E show various views of a sealing valve head. FIG. 19A is a side view showing sealing valve head 320. FIG. 19B is a perspective view showing sealing valve head 320. FIG. 19C is a perspective view showing sealing valve head 320. FIG. 19D is a bottom view showing sealing valve head 320. FIG. 19E is a top view showing sealing valve head 320.

Sealing valve head 320, itself, includes one or more locking features 322. While more than one locking feature 322 is shown, it is to be understood that sealing valve head 320 can include more locking features or less locking features, for instance, a single locking feature 322. Each locking feature 322, itself, includes a shoulder 324 and a ramp 325. Locking features 322 are configured to be inserted through aperture 312 of spring clip 310. When inserted, shoulders 324 are configured to bear against surface 314 of spring clip 310 to securely couple spring clip 310 and sealing head 320. In one example, sealing valve head 320 is a molded body formed of inert and/or FDA approved food grade material(s). Sealing valve head 320 can be of variable dimension to accommodate various different beverage vessels.

While not illustrated in the FIGS., sealing head 320 can include a recess, similar to recess 227 of sealing head 220, configured to receive at least a portion of a sealing element, such as sealing element 330 (shown below). Such a recess can prevent blowout of a sealing element by securely retaining the sealing element within the valve assembly. Further, the recess is a tamper feature in that it serves to prevent or inhibit tampering with the seal and/or sealing element. Additionally, pressure relief valve assembly 340 can, in some examples, act as a tamper-evident device in that the pressure relief valve assembly will weaken when subjected to unequal pressure from outside forces (e.g., prying on portions of the assembly 340 on the top side of the beverage vessel end, such as the valve head 320) such that it will appear different and/or will not be able to maintain a proper seal.

FIGS. 20A-G show various views of a sealing element. FIG. 20A is a side view showing sealing element 330. FIG. 20B is a sectional view showing sealing element 330 at line A-A in FIG. 20A. FIG. 20C is an enlarged view showing portion 331 of sealing element 330. FIG. 20D is a perspective view showing sealing element 330. FIG. 20E is a perspective view showing sealing element 330. FIG. 20F is a bottom view showing sealing element 230. FIG. 20G is a top view showing sealing element 230.

Sealing element 330, itself, includes aperture 332, internal diameter 334, and external diameter 336. Aperture 332 is configured to receive therethrough other portions of a valve assembly, such as locking features 322 of sealing head 320 as well as provide a pathway (e.g., inlet) for fluids to travel through. Sealing element 330 can be of variable dimensions, for example, both the internal diameter 234 and the external diameter 336 can be varied for suitability with various implementations. In one example, sealing element 330 has an internal diameter 334 of 7 mm and an external diameter 336 of 9 mm. Various other dimensions are contemplated herein. Sealing element 330 is configured to sit directly on the beverage vessel end (e.g., lid, top, cap, etc.), for example, on a top side of the beverage vessel end and/or on a bottom side of the beverage vessel end. In other examples, sealing valve head 320 may include a recess, as discussed above, in which at least a portion of sealing element 330 is received. Sealing element 330 provides a fluid-tight seal between an interior and exterior of a beverage vessel. Sealing element 330 is, in one example, a gasket, however, various other sealing elements are contemplated herein, for example, one or more O-rings, one or more sealing washers, one or more grommets, as well as various other suitable sealing elements. In some examples, multiple sealing elements 330 are used in a valve assembly 340, for example, one sealing element 330 on the top side (e.g., configured to contact the top side) of the beverage vessel end (e.g., lid, top, cap, etc.) and another sealing element 330 on the bottom side (e.g., configured to contact the bottom side) of the beverage vessel end.

In one example, sealing element 330 is formed of inert and/or FDA approved food grade material(s). Sealing element 330 can be of variable dimension to accommodate various different beverage vessels.

Figure 22:
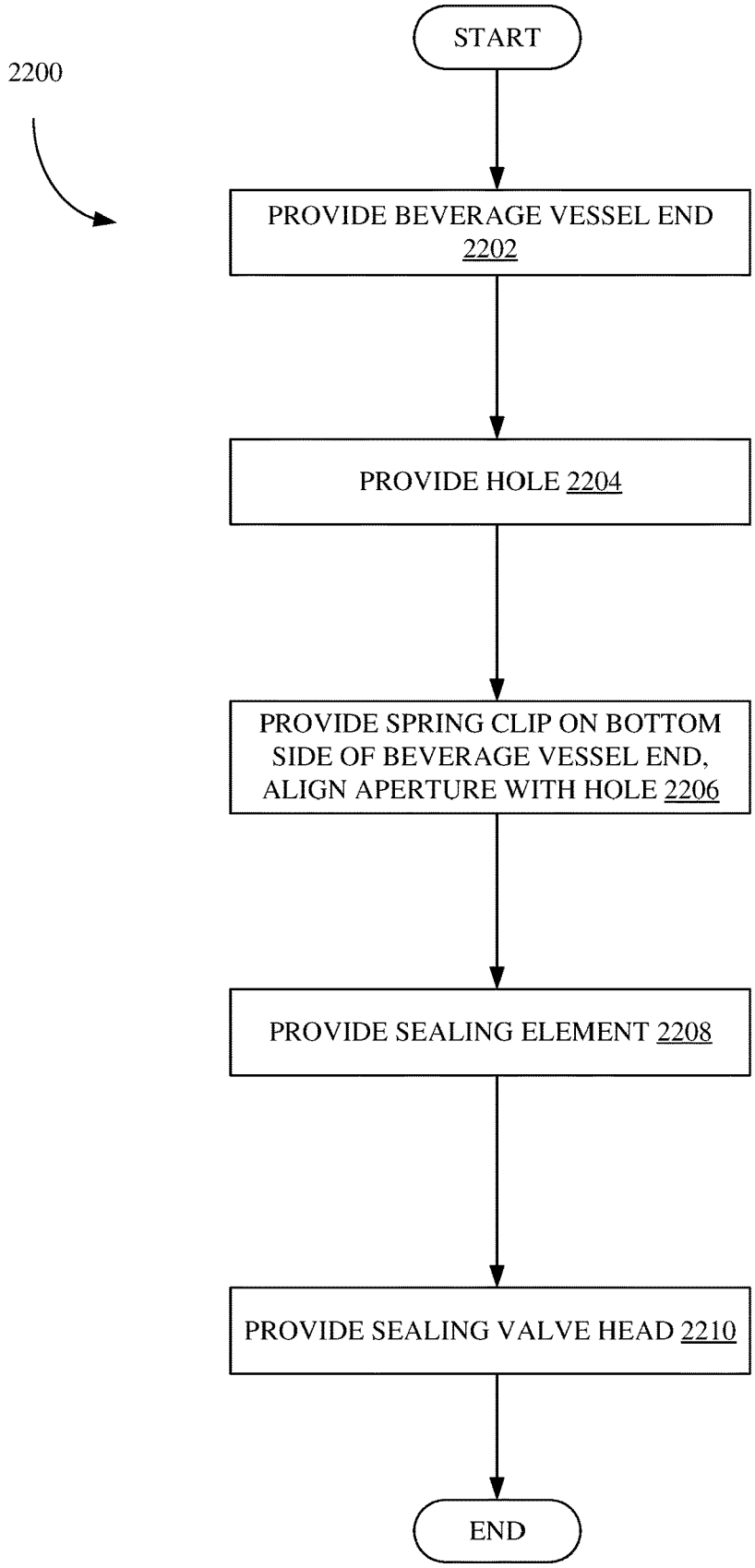
FIG. 22 is a flowchart showing one example of assembling a beverage vessel end assembly.

FIG. 22 is a flowchart showing method 2200 of assembling a beverage vessel end assembly. Method 2200 begins at block 2202 where a beverage vessel end (e.g., beverage vessel cap, top, lid, etc.) is provided. Method 2202 continues at block 2204 where the beverage vessel end is provided with a hole configured to receive the pressure relief valve assembly, or at least a portion of the pressure relief valve assembly. In some examples, the beverage vessel end can be manufactured with a hole as integral part of the beverage vessel end. In other examples, the hole can be "punched" into the beverage vessel end, the punched piece can then be recycled or otherwise disposed of. Method 2200 continues at block 2206 where a spring clip, such as spring clip 210 or spring clip 310, is provided at bottom side of the beverage vessel end, and an aperture of the spring clip, such as aperture 212 or 312, is aligned with the hole in the beverage vessel end. In some examples, at block 2206, standoffs of the spring clip, such as standoffs 216 or 316, contact or bear against the bottom side of the beverage vessel end. Method 2200 continues at block 2208 where a sealing element, such as sealing element 230 or 330, is provided. In some examples, one or more sealing element(s) is provided at the top side and/or bottom side of the beverage vessel end, an aperture of the sealing element, such as aperture 232 or 332, is aligned with the hole in the beverage vessel end. In other examples, providing the sealing element comprises inserting a sealing valve head, such as sealing valve head 220 or 320, or portions thereof, such as locking features 222 or 322, through an aperture of the sealing element.

Method 2200 continues at block 2210 where a sealing valve head, such as sealing valve head 220 or 320 is provided. Providing a sealing valve head at block 2210 comprises inserting a sealing valve head, or a portion thereof, such as locking features 222 or 322, through an aperture of the sealing element, through the hole in the beverage vessel end, and through an aperture in the spring clip. Once inserted into the spring clip, a portion of the sealing vale head, such as shoulder 224 or 324, will bear against a surface of the spring clip, such as surface 214 or 314, to couple the sealing valve head to the spring clip, causing sealing valve head to compress the sealing element to establish a seal. In some examples, compression of the sealing element will yield a contact pressure of at least 40 pounds per square inch (PSI), which will require 40 PSI of internal pressure (e.g., pressure of volume of gas(es) in the interior of beverage vessel) to breach the seal. Once the internal pressure within the beverage vessel is greater than the contact pressure of the seal the beverage vessel will vent, by virtue of the actuation of the pressure relief valve assembly.

FIG. 23A-27K illustrate one example embodiment of a pressure actuated pressure relief valve. With reference first to FIGS. 27A-27K, FIGS. 27A-K show various views of a beverage vessel assembly 460 including a beverage end assembly 461 and a pressure relief valve assembly 450. FIG. 27A is a side view showing beverage vessel assembly 460. FIG. 27B is a side view showing beverage vessel assembly 460. FIG. 27C is an enlarged sectional view showing portion 494 of beverage vessel assembly 460. FIG. 27D is a top view showing beverage vessel assembly 460. FIG. 27E is an enlarged view showing portion 495 of beverage vessel assembly 460. FIG. 27F is a perspective view showing beverage vessel assembly 460. FIG. 27G is an enlarged view showing beverage vessel assembly 460. FIG. 27H is a bottom view showing beverage vessel assembly 460. FIG. 27I is an enlarged view showing portion 497 of beverage vessel assembly 460. FIG. 27J is a perspective view showing beverage vessel assembly 460. FIG. 27K is an enlarged view showing portion 498 of beverage vessel assembly 460. Beverage vessel assembly 460 include beverage vessel 470, illustratively shown as a beverage can (e.g., beer can). Beverage vessel 470 includes rim 471. As will be appreciated, some items shown in FIG. 27B are illustrated in phantom, such as beverage vessel 470. As shown in FIG. 27B, beverage vessel assembly 460 includes pressure relief valve assembly 450.

Pressure relief valve assembly 450 includes bottom clip 410, valve housing 420, valve safety cap 430, and spring sealing element 440. As will be appreciated, fluid, such as gas(es) produced by a live beverage within beverage vessel assembly 460, flow through inlets 414, the gaps between locking features 412 and aperture 426 and is exposed to bottom surface 442 of spring sealing element 440. The pressure of the gas(es) can eventually overcome the resistance of sealing element 440 which actuates (e.g., deforms, compresses, etc.) spring sealing element 440, causing a valve driving movement in the direction indicated by arrow 480, in which portions of spring sealing element 440 move upward into gap 465 (e.g., gap between underside of valve safety cap 430 and top surface 443 of spring sealing element 440) to a valve open position wherein there a gap is opened between bottom surface 442 and surface 429 of valve housing 420 allowing the flow of fluid, such as the volume of gas(es), therethrough. The fluid can escape valve assembly 450, and thus beverage vessel assembly 460, through apertures 434 of valve safety cap 430. Once the pressure on the interior of beverage vessel assembly 460 reduces sufficiently, spring sealing element actuates back to a valve closed position (as shown), in the direction indicated by arrow 490, wherein the fluid-tight sealed interface 478 between bottom surface 442 and surface 429 of valve housing 420 is reestablished.

As illustrated in FIG. 27D, beverage vessel assembly 460 includes beverage vessel end assembly 461 which includes beverage vessel lid 462, rim 463, tab 464, mouth 465, and pressure relief valve assembly 450. While the dimensionality and placement of pressure relieve valve assembly 450 can be varied, in one example, pressure relief valve assembly 450 is configured such that it does not restrict or otherwise interfere with the stacking of beverage vessels, such as beverage cans, for instance, in one example, valve assembly 450 is placed far enough away from rim 463 and has a low enough height (e.g., lower than rim 463) such that another beverage vessel (e.g., beverage vessel can) can be stacked on top of the beverage vessel of which pressure relief valve assembly 450 is a part.

Figure 23C:
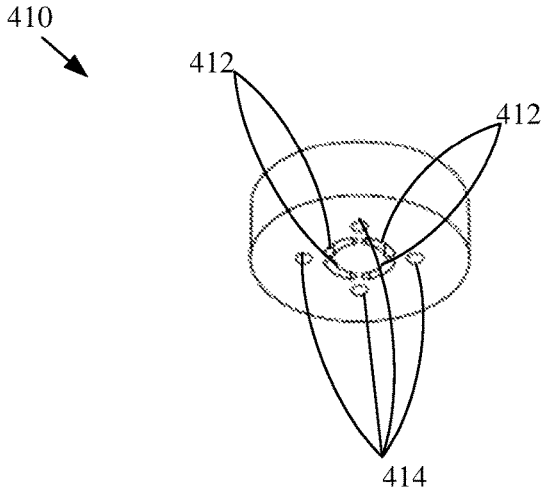
FIG. 23C is a perspective view showing one example bottom clip.
Figure 23E:
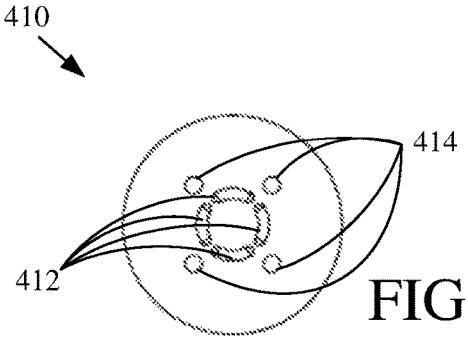
FIG. 23E is a bottom view showing one example bottom clip.
Figure 23F:
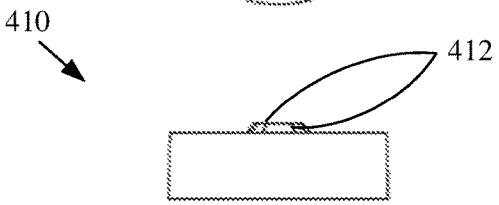
FIG. 23F is a side view showing one example bottom clip.
Figure 23B:
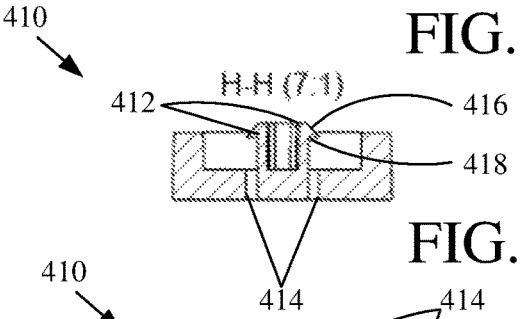
FIG. 23B is a sectional view showing one example bottom clip.
Figure 23D:
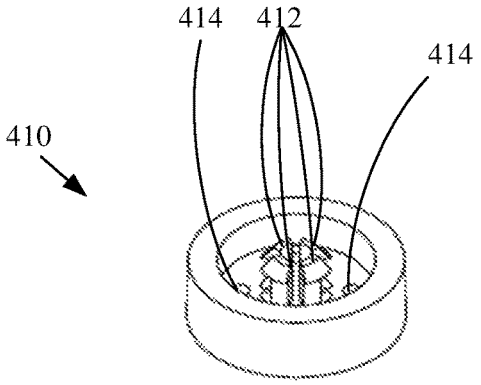
FIG. 23D is a perspective view showing one example bottom clip.
Figure 23A:
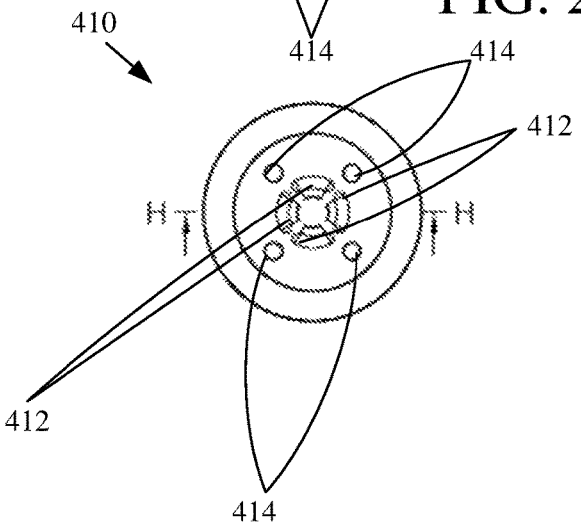
FIG. 23A is a top view showing one example bottom clip.

FIGS. 23A-F show various views of a bottom clip. FIG. 23A is a top view showing bottom clip 410. FIG. 23B is a sectional view showing bottom clip 410 at line H-H shown in FIG. 23A. FIG. 23C is a perspective view showing bottom clip 410. FIG. 23D is a perspective view showing bottom clip 410. FIG. 23E is a bottom view showing bottom clip 410. FIG. 23F is a side view showing bottom clip 410.

Bottom clip 410, itself, includes one or more locking features 412 and one or more inlets 414. While more than one locking feature 412 is shown, it is to be understood that bottom clip 410 can include more locking features or less locking features, such as a single locking feature 412. While more than one inlet 414 is shown, it is to be understood that bottom clip 410 can include more inlets or less inlets, such as a single inlet 414. Inlets 414 provide a pathway for fluid to travel through to access an interior of valve housing. As will be appreciated, there are gaps between each individual locking feature 412 through which fluid can travel. In one example, bottom clip 410 is a molded body formed of inert and/or FDA approved food grade material(s). Bottom clip 410 can be of variable dimension to accommodate various different beverage vessels.

As illustrated, each locking feature 412 includes a ramp 416 and a shoulder 418. Locking features 412 are configured to be received by corresponding portions of a valve assembly, such as aperture 426 and surface 428 of valve housing 420. Locking features 412 provide coupling between bottom clip 410 and valve housing 420.

Figure 24B:
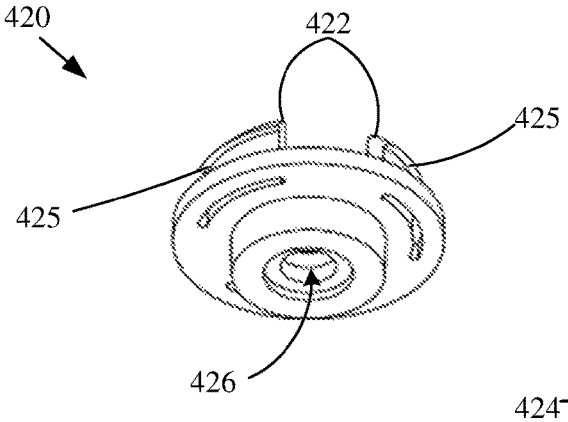
Figure 24C:
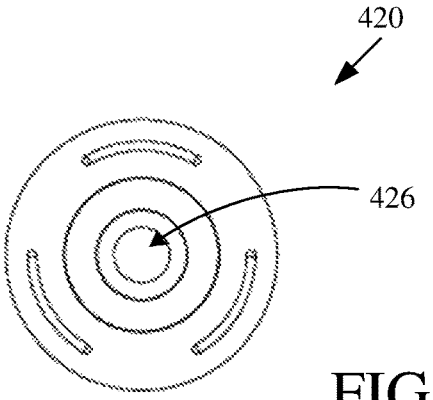
Figure 24E:
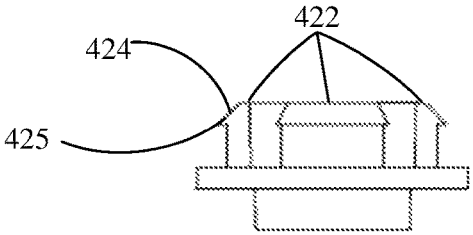
Figure 24A:
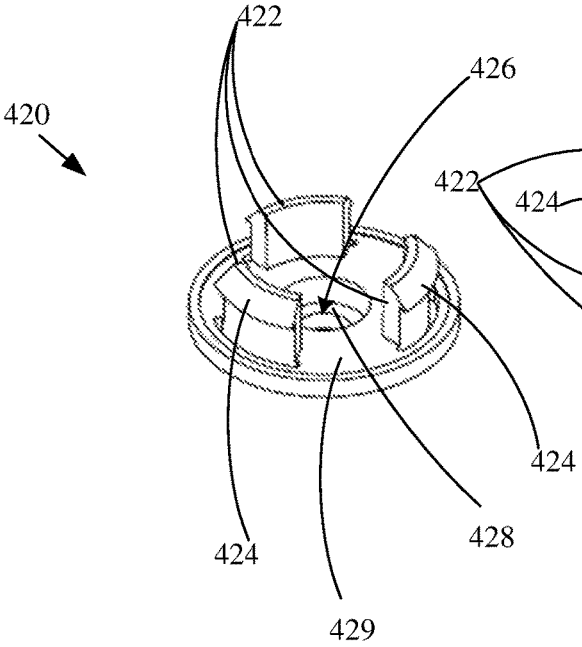
Figure 24D:
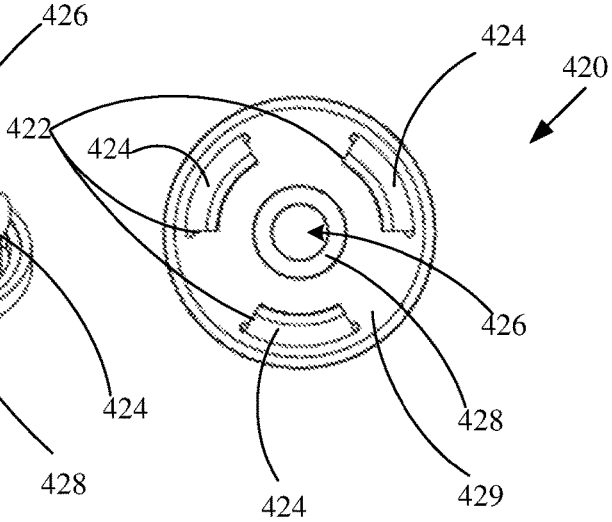

FIGS. 24A-E show various views of a valve housing. FIG. 24A is a perspective view showing valve housing 420. FIG. 24B is a perspective view showing valve housing 420. FIG. 24C is a bottom view showing valve housing 420. FIG. 24D is a top view showing valve housing 420. FIG. 24E is a side view showing valve housing 420.

Valve housing 420, itself, includes locking features 422, aperture 426, surface 428 and surface 429. Each locking feature 422 includes a ramp 424 and shoulder 425. Locking features 422 are configured to be received by corresponding portions of a valve assembly, such as apertures 434 and locking feature 432 of valve safety cap 430. Locking features 422 provide coupling between valve housing 420 and valve safety cap 430. Locking features 412 of bottom clip 410 are received through aperture 426 and shoulders 418 of bottom clip 410 are configured to bear against surface 428 of valve housing 420 to provide coupling between bottom clip 410 and valve housing 420. As will be appreciated, aperture 426 and the gaps between locking features 412 provide a pathway for fluid to travel through even when valve housing 420 and bottom clip 410 are coupled. Surface 429 provides a surface against which a sealing element, such as sealing element 440 (shown below) can bear against to create a fluid-tight sealed interface.

While more than one locking feature 422 is shown, it is to be understood that in other examples, valve housing 420 may include more locking features or less locking features, such as only a single locking feature 422. In one example, valve housing 420 is a molded body formed of inert and/or FDA approved food grade material(s). Valve housing 420 can be of variable dimension to accommodate various different beverage vessels.

FIGS. 25A-F show various views of a valve safety cap. FIG. 25A is a top view showing valve safety cap 430. FIG. 25B is a sectional view showing valve safety cap 430 at line G-G shown in FIG. 25A. FIG. 25C is a bottom view showing valve safety cap 430. FIG. 25D is a perspective view showing valve safety cap 430. FIG. 25E is a perspective view showing valve safety cap 430. FIG. 25F is a side view showing valve safety cap 430.

Valve safety cap 430, itself, includes one or more locking features 432, one or more apertures 434, and one or more walls 435. Locking features 432 each include a surface 433. Surface 433 provides a surface for a corresponding shoulder 425 of a corresponding locking feature 422 of valve housing 420 to bear against to couple valve safety cap 430 to valve housing 420. Locking features 422 of valve housing 420 are configured to be received by apertures 434 of valve safety cap 430 and bear against a corresponding surface 433 of a corresponding locking feature 432 of valve safety cap 430. Apertures 432 provide a pathway (e.g., inlet, outlet, etc.) for fluid to travel therethrough. When valve housing 420 and valve safety cap 430 are coupled (as is shown in FIG. 27C) apertures 434 remain open, allowing the travel of fluid therethrough.

While more than one locking feature 432 is shown, it is to be understood that in other examples, valve safety cap 430 may include more locking features or less locking features, such as only a single locking feature 432. In one example, the number of locking features 432 corresponds to the number of locking features 422 of valve housing 420. While more than one aperture 434 is shown, it is to be understood that in other examples, valve safety cap 430 may include more apertures or less apertures, such as only a single aperture 434. In one example, the number of apertures 434 corresponds to the number of locking features 422 of valve housing 420. In one example, valve safety cap 430 is a molded body formed of inert and/or FDA approved food grade material(s). Valve safety cap 430 can be of variable dimension to accommodate various different beverage vessels.

As illustrated in FIG. 25D, valve safety cap 430 further includes a protrusion 437 configured to contact a portion of a valve assembly, for example, a portion of top surface 443 of sealing element 440 to form and maintain a seal between spring sealing element 440 and valve housing 420.

FIGS. 26A-D show various views of a spring sealing element. FIG. 26A is a side view showing spring sealing element 440. FIG. 26B is a perspective view showing spring sealing element 440. FIG. 26C is a perspective view showing spring sealing element 440. FIG. 26D is a top or bottom view showing spring sealing element.

Spring sealing element 440, itself, includes bottom surface 442 and top surface 443. Spring sealing element 440 is configured to be received by valve housing 420 (e.g., between locking features 422 and over aperture 426) wherein bottom surface 442 of spring sealing element 440 is configured to bear against surface 429 of valve housing 420. Spring sealing element 440 is both a sealing element, in that it provides a seal, and a spring element in that it naturally biases to a valve closed position to establish the seal.

When the pressure relief valve assembly is assembled, protrusion 437 of valve safety cap 430 bears against top surface 443 of spring sealing element to create and maintain a fluid-tight sealed interface between spring sealing element 440 and valve housing 440. A force (e.g., pressure of a volume of atmospheric gas(es)) can bear against top surface 443 of spring sealing element 440 to create and/or maintain a fluid-tight sealed interface between spring sealing element 440 and valve housing 420. Apertures 434 of valve safety cap allow atmospheric gas(es) access and exposure to spring sealing element 440, and thus top surface 443, when valve safety cap 430 is coupled to valve housing 420. Additionally, the force of gravity, when the beverage vessel is upright, can serve to create and/or maintain the seal. Spring sealing element 440 is of a material and dimension to have a set resistance, however spring sealing element is actuatable (e.g., deformable, compressible, etc.) in response to a force, such as a pressure of a volume of gas(es) produced by a live beverage in a beverage vessel. The actuation (e.g., deformation, compression) of spring sealing element 440 provides a gap between bottom surface 442 of spring sealing element 440 and surface 429 of valve housing 420 through which fluid can travel. In some examples, spring sealing element 440 is formed of silicone (e.g., food grade silicone). In one example, spring sealing element 440 is formed of inert and/or FDA approved food grade material(s). Spring sealing element 440 can be of variable dimension to accommodate various different beverage vessels.

FIG. 28 is a flowchart showing method 2800 of assembling a beverage vessel end assembly. Method 2800 begins at block 2802 where a beverage vessel end (e.g., beverage vessel cap, top, lid, etc.) is provided, such as, but not limited to, lid 462. Method 2800 continues at block 28004 where the beverage vessel end is provided with a hole configured to receive the pressure relief valve assembly, such as pressure relief valve assembly 450, or at least a portion of the pressure relief valve assembly. In some examples, the beverage vessel end can be manufactured with a hole as integral part of the beverage vessel end. In other examples, the hole can be "punched" into the beverage vessel end, the punched piece can then be recycled or otherwise disposed of.

Method 2800 proceeds at block 2806 where a bottom clip, such as bottom clip 410 is coupled to a valve housing, such as valve housing 420. In one example, coupling a bottom clip to a valve housing includes inserting locking features, such as locking features 412, through an aperture of the valve housing, such as aperture 426, wherein a shoulder of the locking feature, such as shoulder 418, will bear against a surface of the valve housing, such as surface 428.

Method 2800 proceeds at block 2808 where a spring sealing element, such as spring sealing element 440 is provided. In one example, providing a spring sealing element includes housing the spring sealing element in the valve housing, such as in the space between locking features 422 of valve housing 420, wherein the spring sealing element will engage a surface of the valve housing, such as surface 429 of valve housing 420.

Method 2800 proceeds at block 2810 where a valve safety cap, such as valve safety cap 430, is coupled to the valve housing. In one example, coupling the valve safety cap 430 includes inserting locking features of the valve housing, such as locking features 422 of valve housing 420, through corresponding apertures of the valve safety cap, such as apertures 434 of valve safety cap 430, wherein a shoulder of the locking feature, such as shoulder 425 of locking feature 422, will engage a surface of a locking feature of the valve safety cap, such as surface 433 of locking feature 432 of valve safety cap 430. In one example, coupling the valve safety cap to the valve housing includes providing contact between a protrusion on the bottom side of the valve safety cap, such as protrusion 437 of valve safety cap 430, with a surface of the spring sealing element, such as top surface 443 of spring sealing element 440, which provides a fluid-tight sealed interface between spring sealing element (or a portion thereof) and valve housing (or a portion thereof), such as sealed interface between bottom surface 442 of spring sealing element 440 and surface 429 of valve housing 420.

Method 2800 proceeds at block where the assembled pressure relief valve assembly, such as pressure relief valve assembly 450, is inserted through the hole in the beverage vessel end.

It will be appreciated that the beverage vessel end assembly, including the pressure relief valve assembly can then be coupled to a corresponding beverage vessel to seal a beverage therein, such as during a canning or bottling process. In other examples, the beverage vessel end can already be coupled to a corresponding beverage vessel and the pressure relief valve assembly can be incorporated therein.

FIG. 29A is a bottom view showing beverage vessel end 500. In the illustrated example, beverage vessel end is a beverage vessel lid, such as a beverage can lid, though, in other example, beverage vessel end can be any of a number of beverage vessel ends, such as a bottle cap, a can lid, a beverage vessel top, etc. As illustrated, beverage vessel end 500 includes hole 502. Hole 502 is configured to receive a pressure relief valve assembly (or portion(s) thereof), such as any of the pressure relief valve assemblies (or portion(s) thereof) described herein. In some examples, the beverage vessel end can be manufactured with hole 502 as integral part of the beverage vessel end. In other examples, hole 502 can be "punched" into the beverage vessel end, the punched piece can then be recycled or otherwise disposed of.

FIG. 29B is an enlarged view showing portion 504 of beverage vessel end 500.

It should be noted that, in some examples, the various pressure actuated pressure relief valves discussed herein can include a weight instead of, or in addition to, a spring element, for example, a weight external to or internal to the pressure actuated pressure relief valve the biases the pressure relief valve to a closed position, such as a weight that is hung from a component of the pressure relief valve, the downward (e.g., towards the interior of the beverage vessel) force of the weight biasing the pressure relief valve to a closed position, wherein a pressure of a volume of gas produced by a live beverage overcomes the downward force of the weight to drive movement of the pressure relief valve to a valve open position.

Alternatively, or in addition to a spring element and/or a weight, one or more of the components of the various pressure actuated pressure relief valves (or a component added to the various pressure actuated pressure relief valves described herein) can have an elasticity and/or compressibility that biases the valve to a closed position and drives movement of the valve to an open position, in response to a pressure of a volume of gas produced by a live beverage.

In some examples, the compressibility and/or elasticity of the material, and/or the weight, may provide sufficient sealing such that a separate sealing element is not necessary.

In some examples, an over-molding process could be utilized to adhere a material, such as thermoplastic elastomer (TPE), to the valve head, such as to provide a seal.

In other examples, a pressure actuated pressure relief valve assembly can include one or more chambers (such as one or more chambers disposed above the beverage vessel end) having a sealed volume that has a pressure that biases the pressure relief valve to a closed position, wherein the internal pressure of the volume of gas(es) produced by the live beverage drive movement of the pressure relief valve when the internal pressure overcomes the pressure sealed in the one or more chambers.

Furthermore, while the various pressure actuated pressure relief valve assemblies (or at least some components thereof) described herein are shown, in some examples, as generally cylindrical, in other examples, the various embodiments can be altered in design to be more ergonomic with respect to contours of the various different beverage vessels with which the pressure relief valves may be incorporated.

In addition, while the various pressure actuated pressure relief valve assemblies described herein utilize various locking features, illustrated as clip(s) and/or snapping features, in other examples, other types of locking features for coupling the various components of the valve assemblies can be utilized, for instance, mating features (e.g., female and male components). For example, in some embodiments, the locking features can comprise a twist and secure design, where one component would be coupled to another component by twisting and securing.

It should also be noted that the different embodiments described herein can be combined in different ways. That is, parts of one or more embodiments can be combined with parts of one or more other embodiments. All of this is contemplated herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A can lid, comprising:

a flat surface;

a tab attached to the flat surface and positioned next to a mouth opening formed in the flat surface;

an aperture formed in the flat surface located adjacent to the mouth opening, the aperture being separate and distinct from the mouth opening; and a pressure actuated relief valve disposed in the aperture, the pressure actuated relief valve being configured to move between an open and closed state in response to changes in pressure caused by an increase or decrease of pressure inside of a can of which the can lid has been made a part.

2. The can lid of claim 1, further comprising a rim located on an outside edge of the flat surface.

3. The can lid of claim 1, wherein the tab is connected to the flat surface with a can rivet.

4. The can lid of claim 1, wherein the pressure actuated relief valve is configured to move temporarily to an open state in response to an increase of pressure inside of the can.

5. The can lid of claim 1, wherein the pressure actuated relief valve is configured to move to an open state in response to an increase of pressure inside of the can.

6. The can lid of claim 1, wherein the pressure actuated relief valve is configured to move to a closed state in response to a decrease in pressure inside of the can.

7. The can lid of claim 1, wherein the pressure actuated relief valve includes a tamper feature.

8. The can lid of claim 1, wherein the pressure actuated relief valve is comprised of a plastic material.

9. A can lid, comprising:

a mouth opening formed in a flat surface of the can lid;

a pressure actuated relief valve positioned within an opening formed in the flat surface of the can lid, the pressure actuated relief valve being located next to a tab opener and configured to move to and from an open position in response to changes in gas pressure inside of a can to which the can lid has been attached; and wherein the opening having the pressure actuated relief valve is separated from the mouth opening by a portion of the flat surface of the can lid.

10. The can lid of claim 9, wherein the pressure actuated relief valve includes a tamper feature.

11. The can lid of claim 9, wherein the pressure actuated relieve valve is further configured to automatically move to and from the open position in response to the changes in gas pressure inside of the can to which the can lid has been attached.

12. The can lid of claim 9, wherein the gas pressure is released through the opening separate from the mouth opening.

13. The can lid of claim 9, wherein the pressure actuated relief valve is comprised of multiple separate pieces mechanically engaged to one another.

14. A can lid, comprising:

a mouth opening formed in a flat surface of the can lid;

a pressure actuated relief valve positioned next to a tab opener and separate from the mouth opening, wherein the pressure actuated relief valve is configured to automatically move to and from an open position in response to changes in gas pressure inside of a can to which the can lid has been attached; and wherein the gas pressure is released through the pressure actuated relief valve separate from the mouth opening.

15. The can lid of claim 14, wherein the pressure actuated relief valve is further configured to automatically move mechanically to and from the open position in response to changes in gas pressure inside of the can to which the can lid has been attached.

16. The can lid of claim 14, wherein the pressure actuated relief valve is comprised of multiple pieces mechanically engaged to one another.

17. The can lid of claim 14, wherein the pressure actuated relief valve is mechanically biased toward a closed position.

18. The can lid of claim 14, wherein the pressure actuated relief valve includes a biasing mechanism that biases the pressure actuated relief valve toward a closed position.

19. The can lid of claim 14, wherein the pressure actuated relief valve is comprised of a plastic material.

20. The can lid of claim 14, wherein the pressure actuated relief valve includes a spring.

* * * * *